US011840321B2

(12) United States Patent
Lordi

(10) Patent No.: US 11,840,321 B2
(45) Date of Patent: Dec. 12, 2023

(54) OUTBOARD DRIVE ASSEMBLIES

(71) Applicant: Weedoo Greenboat, Inc, West Palm Beach, FL (US)

(72) Inventor: Tara Lordi, Wellington, FL (US)

(73) Assignee: WEEDOO GREENBOAT, INC, West Palm Beach, FL (US)

( * ) Notice: Subject to any disclaimer, the term of this patent is extended or adjusted under 35 U.S.C. 154(b) by 237 days.

(21) Appl. No.: 17/383,632

(22) Filed: Jul. 23, 2021

(65) Prior Publication Data

US 2022/0024551 A1 Jan. 27, 2022

Related U.S. Application Data

(60) Provisional application No. 63/055,481, filed on Jul. 23, 2020.

(51) Int. Cl.

| | |
|---|---|
| ***B63H 20/06*** | (2006.01) |
| ***B63B 35/32*** | (2006.01) |
| ***B63H 5/16*** | (2006.01) |
| ***B63H 20/00*** | (2006.01) |

(52) U.S. Cl.

CPC ..... *B63H 20/06* (2013.01); *B63B 35/32* (2013.01); *B63H 5/165* (2013.01); *B63H 2020/003* (2013.01)

(58) Field of Classification Search

CPC .. B63H 20/06; B63H 5/165; B63H 2020/003; B63B 35/32

See application file for complete search history.

(56) References Cited

U.S. PATENT DOCUMENTS

| | | | | |
|---|---|---|---|---|
| 425,019 | A | 4/1890 | Bower | |
| 756,031 | A | 3/1904 | Lee | |
| 911,939 | A | 2/1909 | Casaday | |
| 3,808,998 | A * | 5/1974 | Molotzak | B63B 39/06 114/65 R |

(Continued)

FOREIGN PATENT DOCUMENTS

CN 109018283 A 12/2018

OTHER PUBLICATIONS

International Search and Written Opinion issued in the corresponding PCT patent application No. PCT/US2021/042888 dated Nov. 9, 2021.

*Primary Examiner* — Stephen P Avila

(74) *Attorney, Agent, or Firm* — Rupam Bhar; Calderon Safran & Cole, P.C

(57) ABSTRACT

An outboard drive assembly for a work boat is provided. In embodiments, an outboard drive assembly includes a lower outdrive assembly including: a housing extending between a first and end a second end and having a motor housed therein; a propeller mounted to the first end of the housing; first and second fins extending horizontally from opposing side portions of the motor housing; a third fin extending vertically from the housing; respective cutting blades attached to respective end portions of each of the first, second and third fins adjacent the propeller; an upper outdrive assembly including mounting brackets configure to connect the upper drive assembly to a deck of a work boat; and a drive arm assembly pivotally mounted to the lower outdrive assembly at a first end of the drive arm assembly and mounted to the upper outdrive assembly at a second end of the drive arm assembly.

16 Claims, 20 Drawing Sheets

(56) References Cited

U.S. PATENT DOCUMENTS

| | | | | |
|---|---|---|---|---|
| 4,141,308 | A * | 2/1979 | Gainey | E02B 15/10 440/37 |
| 4,450,670 | A | 5/1984 | Robinson | |
| 4,718,871 | A | 1/1988 | Mandelevitch | |
| 4,911,664 | A | 3/1990 | Gremillion | |
| 5,017,165 | A | 5/1991 | Havins | |
| 5,807,150 | A | 9/1998 | Minter, Sr. | |

* cited by examiner

OUTBOARD DRIVE ASSEMBLIES

TECHNICAL FIELD

Aspects of the present invention relate generally to outboard boat drives and, more particularly, to an outboard drive assemblies for a work boat.

BACKGROUND

Underwater foliage and other debris may wrap around the propeller of boat motors, potentially damaging the motor. Various cutting tools adapted to attach to a boat motor have been proposed for the purpose of cutting foliage in order to prevent damage to the boat motor. For example, U.S. Pat. No. 4,450,670 discloses a blade assembly with a cutting section overlying a rotating hub of a propeller assembly.

SUMMARY OF THE INVENTION

In embodiments, an outboard drive assembly for a work boat comprises: a lower outdrive assembly including: a motor housing extending between a first end and a second end, the motor housing including a motor housed therein; a propeller mounted to the first end of the motor housing, the propeller including propeller blades adapted to rotate about a longitudinal axis of the motor housing; a first fin extending outward from a first sidewall portion of the motor housing, the first fin including a first cutter extending from an end portion of the first fin adjacent the propeller blades, wherein a cutting blade of the first cutter has a sharp length that extends from a first end adjacent the motor housing to a second end spaced outward from the motor housing; a second fin extending outward from a second sidewall portion of the motor housing, the second fin including a second cutter extending from an end portion of the second fin adjacent the propeller blades, wherein a cutting blade of the second cutter has a sharp length that extends from a first end adjacent the motor housing to a second end spaced outward from the motor housing; and a third fin extending outward from a first sidewall portion of the motor housing, the third fin including a third cutter extending from an end portion of the third fin adjacent the propeller blades, wherein a cutting blade of the third cutter has a sharp length that extends from a first end adjacent the motor housing to a second end spaced outward from the motor housing.

In embodiments, a work boat comprises: a hull; a deck attached to the hull; first and second outboard drive assemblies mounted at opposing side portions of the deck, wherein each of the first and second outdrive assemblies include a lower outdrive assembly including: a motor housing extending between a first end and a second end, the motor housing including a motor housed therein; a propeller mounted to the first end of the motor housing, the propeller including propeller blades adapted to rotate about a longitudinal axis of the motor housing; a first fin extending outward from a first sidewall portion of the motor housing, the first fin including a first cutter extending from an end portion of the first fin adjacent the propeller blades, wherein a cutting blade of the first cutter has a sharp length that extends from a first end adjacent the motor housing to a second end spaced outward from the motor housing; a second fin extending outward from a second sidewall portion of the motor housing, the second fin including a second cutter extending from an end portion of the second fin adjacent the propeller blades, wherein a cutting blade of the second cutter has a sharp length that extends from a first end adjacent the motor housing to a second end spaced outward from the motor housing; and a third fin extending outward from a first sidewall portion of the motor housing, the third fin including a third cutter extending from an end portion of the third fin adjacent the propeller blades, wherein a cutting blade of the third cutter has a sharp length that extends from a first end adjacent the motor housing to a second end spaced outward from the motor housing.

BRIEF DESCRIPTION OF THE DRAWINGS

Aspects of the present invention are described in the detailed description which follows, in reference to the noted plurality of drawings by way of non-limiting examples of exemplary embodiments of the present invention.

DESCRIPTION OF EMBODIMENTS

Aspects of the present invention relate generally to outboard drives and, more particularly, to outboard drive assemblies for a work boat. Embodiments of the invention provide hydraulically powered outboard drives for a work boat that enable the work boat to travel through thick weed beds without damaging the outboard drive assemblies. Implementations of the invention provide outboard drives including foliage/debris cutters positioned at the end of fins to maintain an overall streamlined shape to limit drag and improve hydrodynamics of the outboard drives. In embodiments, the shape of the outboard drives and integrated cutters prevents foliage/debris from slowing the propulsion of the hydraulic powered outboard drives.

Figure 1:
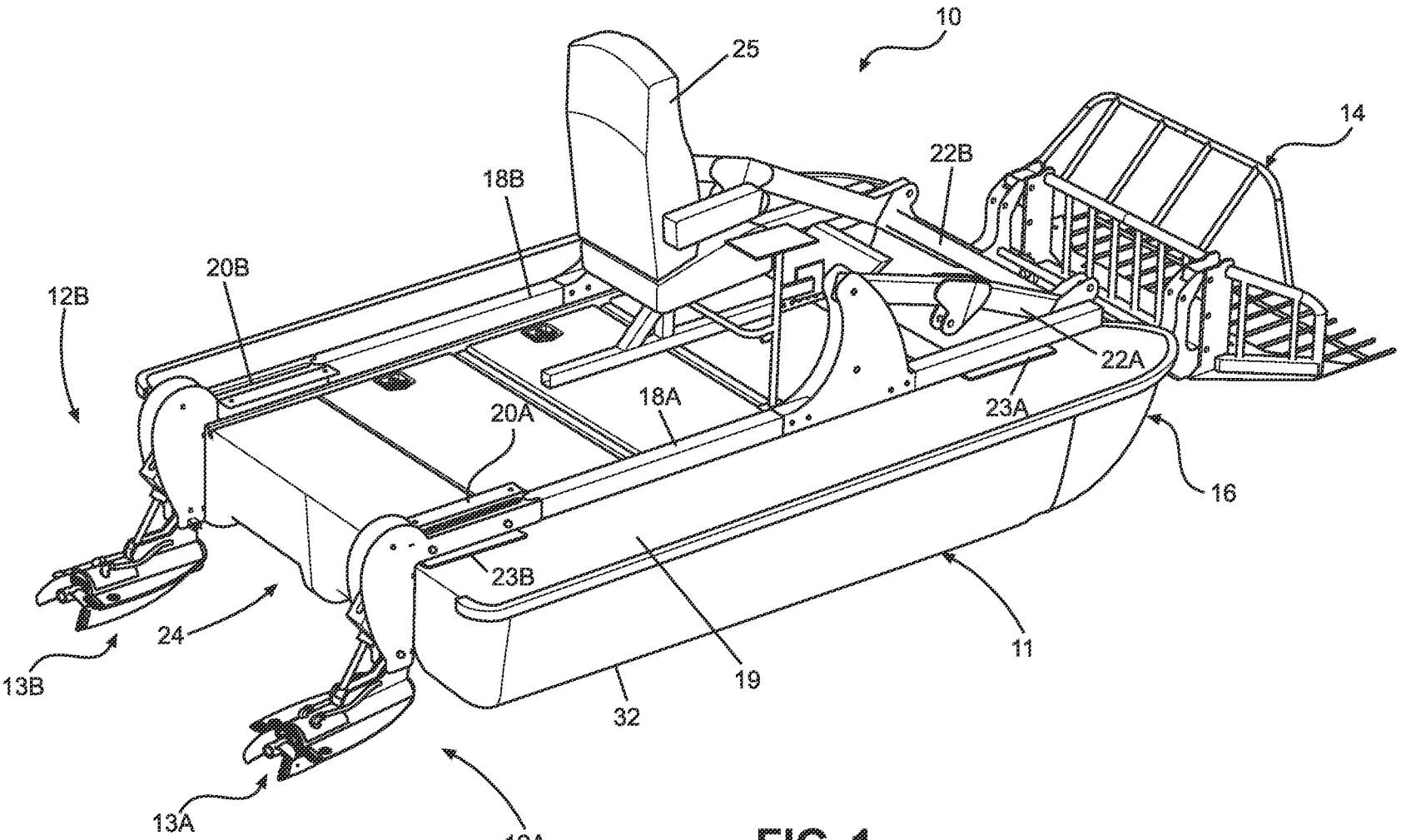
FIG. 1 depicts an exemplary work boat including outboard drive assemblies according to embodiments of the invention.

FIG. 1 depicts an exemplary work boat 10 including a hull 11 and outboard drive assemblies 12A, 12B of the present invention mounted thereto. In implementations, the outboard drive assemblies 12A and 12B each include a respective lower outdrive assembly 13A, 13B. The exemplary work boat 10 includes a work tool 14 mounted to extend over a front or bow 16 of the work boat 10, mounting rails 18A, 18B mounted to an upper surface (deck) 19 of the work boat 10, and the outboard drives 12A, 12B mounted to the deck 19 and/or respective mounting rails 18A, 18B via respective mounting assemblies 20A, 20B (upper outdrive assemblies) at the back or stern of the work boat 10. In implementations, the mounting tool 14 is mounted to the mounting rails 18A, 18B of the work boat 10 via respective pivoting arms 22A, 22B. In aspects of the invention, the mounting rails 18A, 18B are welded to the work boat 10. In implementations, the mounting rails 18A, 18B are fastened to the upper surface 19 of the work boat 10 via respective set of brackets (e.g., brackets 23A, 23B) and fasteners (e.g., screws, or bolts not shown). In the example of FIG. 1, a first outboard drive assembly 12A is mounted via the mounting assembly 20A to a starboard side of a back end 24 of the work boat 10, while a second outboard drive assembly 12B is mounted via the mounting assembly 20B to a port side of the work boat 10. The work boat 10 may include other features, such as a seat 25, controls (not shown), and attachable accessories or equipment. The invention is not intended to be limited by the work boat examples included herein.

Figure 2:
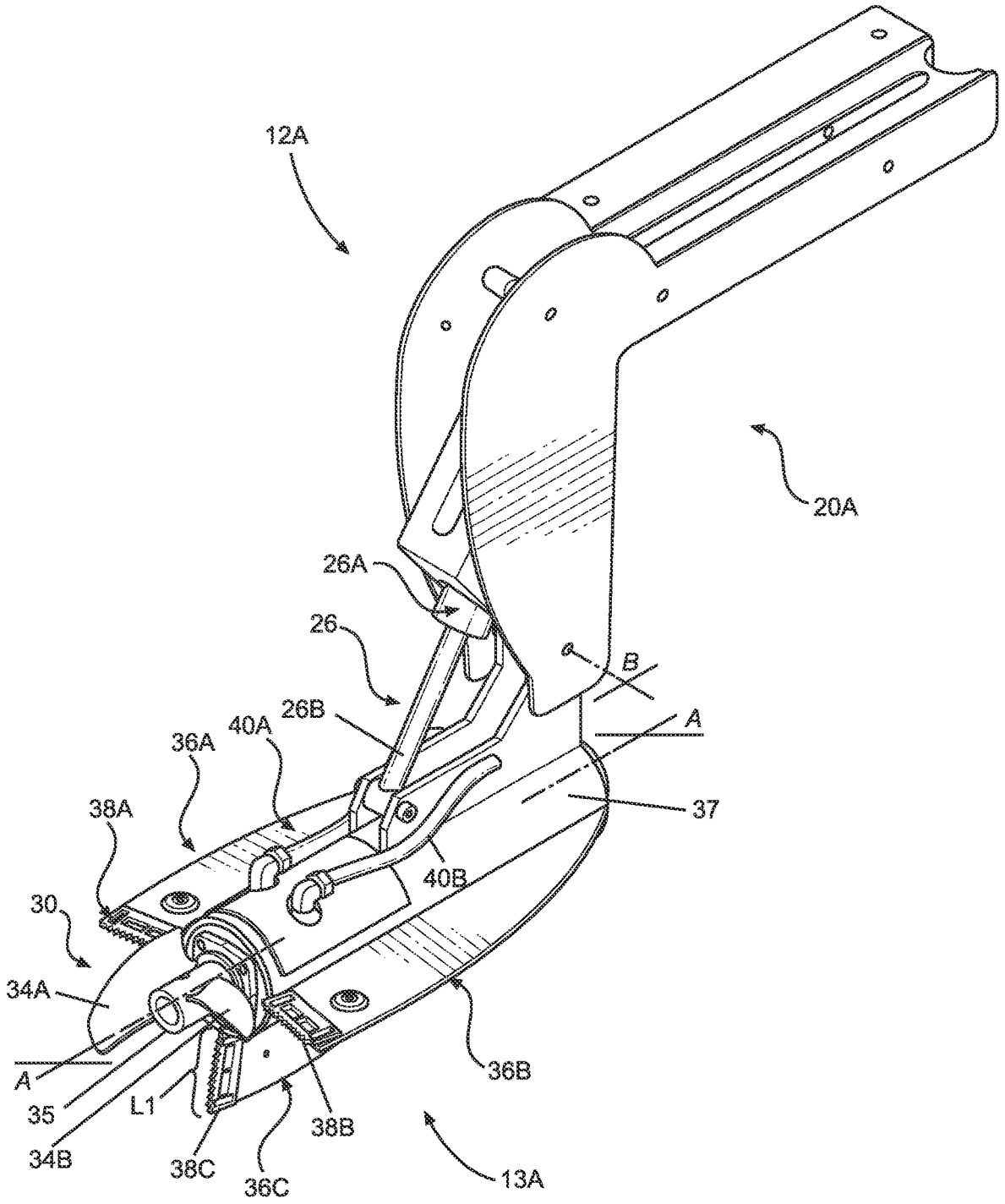
FIG. 2 depicts an outboard drive assembly of FIG. 1 according to embodiments of the invention.

FIG. 2 depicts an outboard drive assembly 12A of FIG. 1 according to embodiments of the invention. As depicted in FIG. 2, the mounting assembly 20A is rotatably connected to the lower outdrive assembly 13A by a drive arm assembly 26. In implementations, the drive arm assembly 26 comprising a cylinder 26A and an arm 26B configured to extend and retract from the cylinder 26A to rotate the outboard drive assembly 12A about an axis B, between a lowered (in-use) position shown in FIG. 2 and a raised (travel) position wherein a propeller (prop) 30 is raised upward in the direction of the mounting assembly 20A and away from a bottom 32 of the work boat 10 (as shown in FIG. 1). In one example, the drive arm 26 comprises a 1' bore, 6" stroke, 12 VDC (volts direct current) Falcon™ actuator, with manual override. It should be understood that when the work boat 10 is in a body of water, the outboard drives 12A, 12B may be positioned in the water in an in-use position, but can trim up high to a position outside of the water for transport of the work boat 10 out of the water. The exemplary propeller 30 of FIG. 2 includes two propeller blades 34A and 34B extending from a hub 35, however, other types of propellers may be utilized.

In embodiments, the outboard drive assembly 12A includes a plurality of fixed fins 36A-36C (e.g., aluminum fins) extending from a motor housing 37, each of which includes a respective cutter 38A-38C mounted to an end thereof adjacent the propeller 30. In embodiments, the fixed fins 36A-36C comprise opposing planar surfaces that extend perpendicularly from a surface of the motor housing 37. In implementations, the hub 35 of the propeller 30 is adapted to rotate about a longitudinal axis A of the motor housing 37. Cutters 38A-38C may each comprise one or more replaceable blades (e.g., metal blades). In implementations, each of the cutters 38A-38C extends lengthwise outward from the longitudinal axis A of the motor housing 37. In aspects of the invention the cutters 38A-38C each include a blade extending perpendicular to or essentially perpendicular to (i.e., within 1-5, or 1-10 degrees from perpendicular) the longitudinal axis A of the motor housing 37. In embodiments, each blade of the cutters 38A-38C has a sharp length (e.g., L1) that extends along a planar portion of a fixed fin (36A-36C) from a first end adjacent the motor housing 37 to a second end outward away from the motor housing 37. With the cutters 38A-38C positioned in the same plane as the respective fins 36A-36C, the cutters do not interfere with the hydrodynamics of the lower outdrive assembly 13A, providing an overall streamlined shape to the lower outdrive assembly 13A. In implementations of the invention, when the outboard drive assembly 12A of the work boat 10 is in use in a body of water, the position of the cutters 38A-38C results in weeds or other debris in the water being cut prior to the debris touching the propeller 30 when the propeller 30 is in motion rotating about the longitudinal axis A.

In the example of FIG. 2, the outboard drive assembly 12A also includes hydraulic hoses or lines 40A and 40B connected thereto. In embodiments, the weight and length of the outboard drive assembly 12A contributes to the center of gravity of the work boat 10 to keep the bottom 32 of the work boat 10 and the propeller 30 in the water when the work boat 10 is picking up heavy loads with the work tool 14. In implementations, a long bullet shape of the outboard drives 12A, 12B allows the work boat 10 to travel efficiently both in the water and out of the water (e.g., on a trailer during transport of the work boat 10 over land). While FIG. 2 depicts outboard drive assembly 12A, it should be understood that outboard drive assembly 12B may include identical structure (or mirror image structure) to that of outboard drive assembly 12A, such that the details of outboard drive assembly 12B are not separately discussed in detail herein.

Figure 3:
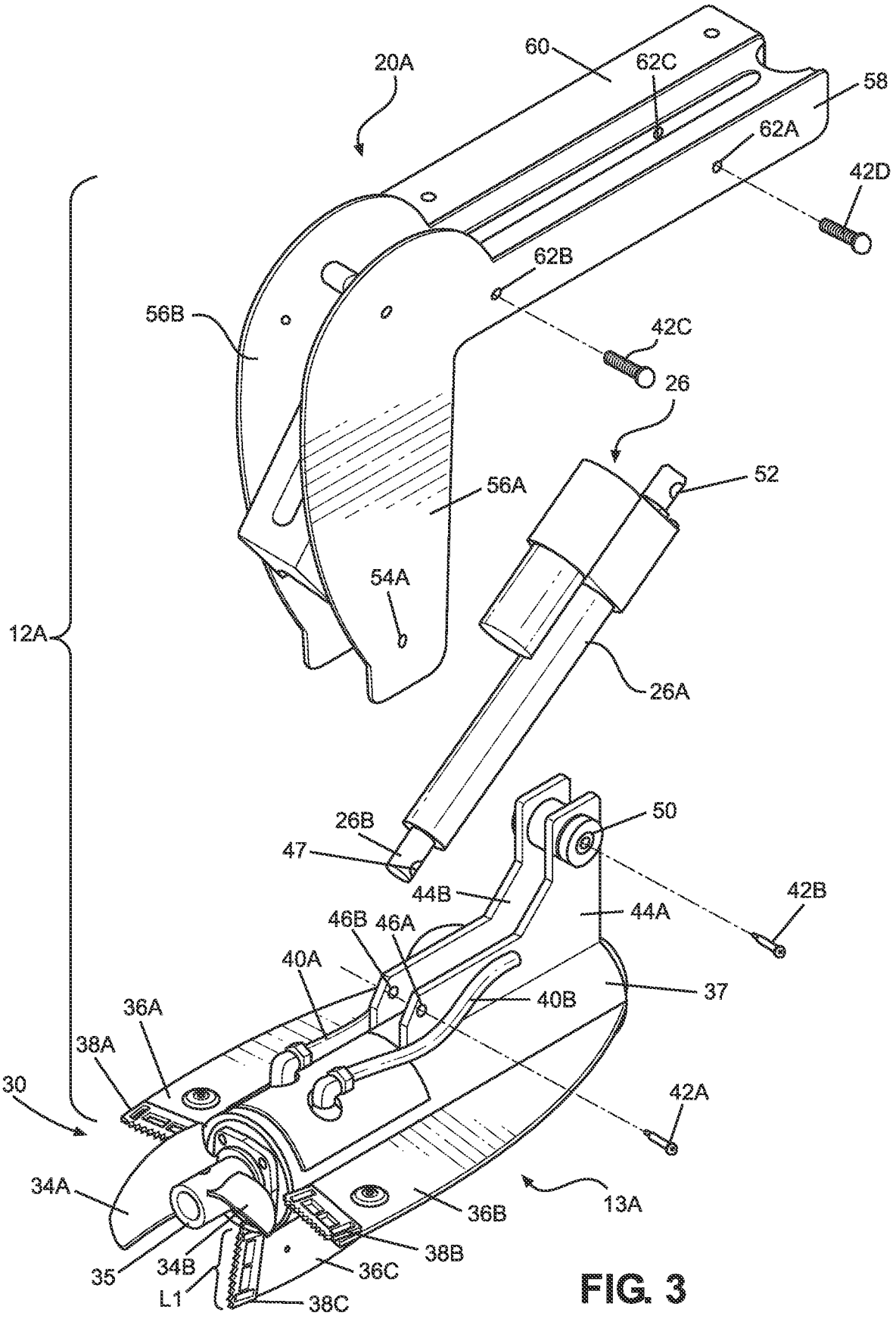
FIG. 3 is a partial exploded view of an outboard drive assembly of FIG. 2 according to embodiments of the invention.
Figure 4:
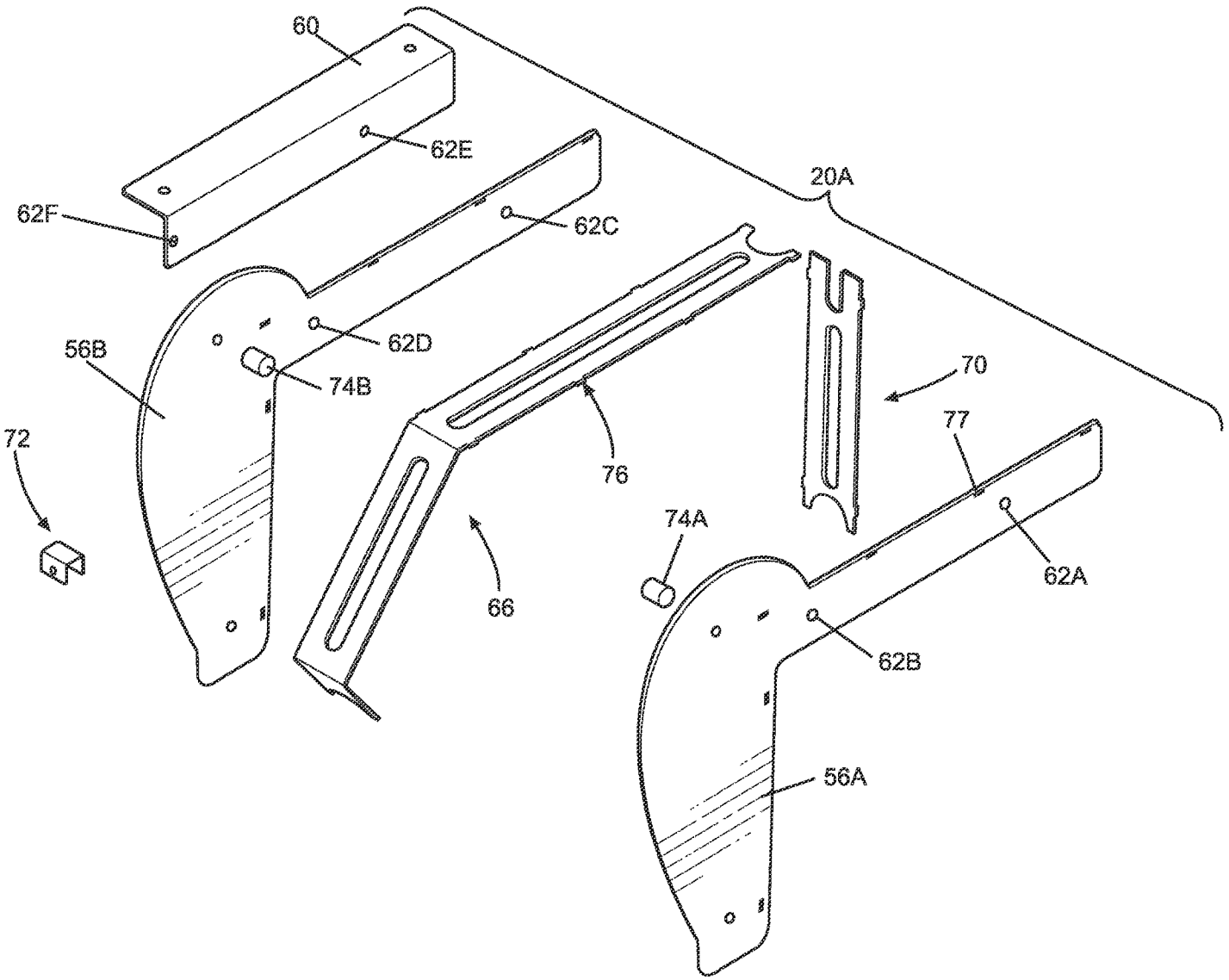
FIG. 4 is an exploded view of a mounting assembly of the outboard drive assembly of FIG. 3 according to embodiments of the invention.

FIG. 3 is a partial exploded view of the outboard drive assembly 12A according to embodiments of the invention. In implementations, a fastener 42A secures the arm 26B of the drive arm 26 between opposing mounting plates 44A, 44B of the outboard drive assembly 12A via extending through apertures 46A, 46B in the respective opposing mounting plates 44A, 44B, and an aperture 47 in the arm 26B. In the example of FIG. 3, another fastener 42B secures the drive arm 26 between the opposing mounting plates 44A, 44B, and secures the drive arm 26 to the mounting assembly 20A, by extending through a connector 50 interconnecting a top portion of the opposing mounting plates 44A, 44B, an aperture 52 in the drive arm 26, and apertures 54A, 54B (of which only 54A is shown in FIG. 3) in opposing side plates 56A, 56B of the mounting assembly 20A. Additional fasteners 42C and 42D are shown for securing an arm 58 of the mounting assembly 20A to a bent brace plate 60 of the mounting assembly 20A via apertures 62A-62F (as shown in FIGS. 3 and 4). In embodiments, the fasteners 42A-42D comprise a shoulder screw and/or a hex head cap screw.

FIG. 4 is an exploded view of a mounting assembly 20A of the outboard drive assembly 12A of FIG. 3 according to embodiments of the invention. In implementations, the mounting assembly 20A includes the opposing side plates 56A and 56B, the bent side bracket 60, an angled brace 66, a top brace plate 70, a small channel piece 72 and spacers 74A, 74B. In embodiments, notches (e.g., see notch 76) extending from the angled brace 66 and the top brace plate 70 are configured to fit in corresponding apertures (e.g., see aperture 77) in the opposing side plates 56A, 56B to secure the angled brace 66 and the top brace plate 70 in place between the opposing side plates 56A, 56B when the mounting assembly 20A is assembled. In implementations, the opposing side plates 56A, 56B protect the drive arm 26 from debris in the water, when in use.

Figure 5A:
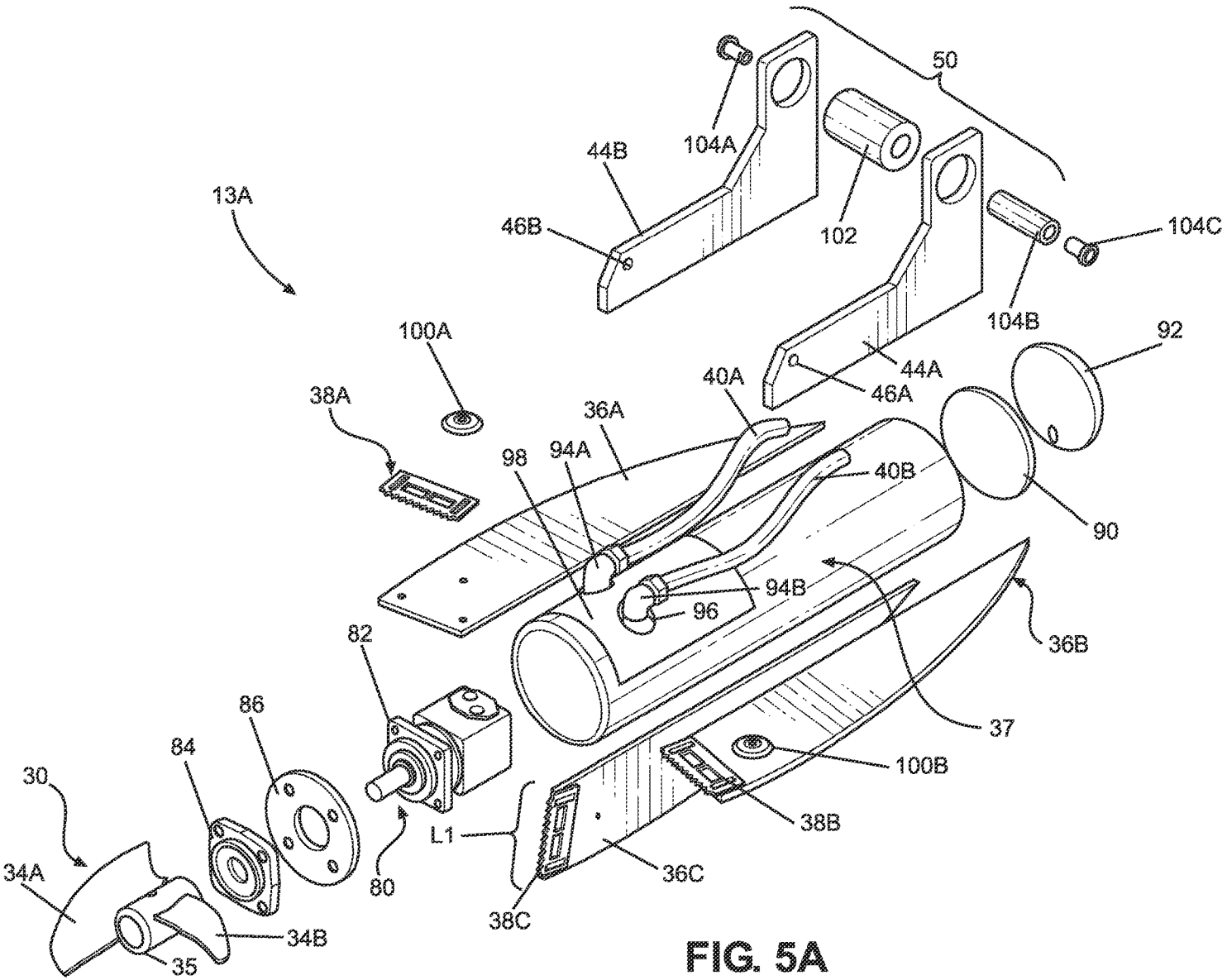
FIG. 5A is an exploded view of a lower outdrive assembly of the outboard drive assembly of FIG. 3 according to embodiments of the invention.

FIG. 5A is an exploded view of a lower outdrive assembly 13A of the outboard drive assembly 12A of FIG. 3 according to embodiments of the invention. In embodiments, the outboard drive assembly 12A includes the propeller 30 connected to a shaft 80 of a hydraulic motor 82, with a machined spacer plate 84 and a housing plate 86 there between. The hydraulic motor 82 is housed within the motor housing 37, which is sealed at a back end with an inner housing plate 90 and a domed cap 92. The fixed fins 36A-36C are mounted or affixed to the motor housing 37, and include the respective cutters 38A-38C including one or more sharp blades adapted to cut water weeds or other water debris. Crimp fittings 94A and 94B connect the respective hydraulic lines 40A and 40B to the hydraulic motor 82 through holes 96 in a cover plate 98 attached to the motor housing 37. The cover plate 98 enables access to the hydraulic motor 82 for ease of maintenance. Connectors 100A, 100B (e.g., round zinc connectors) and 100C (visible in FIG. 6A) attach to the respective fixed fins 36A-36C. The opposing mounting plates 44A and 44B (e.g., ⅜ inch mount "L" plates) are connected via the connector 50, which comprises a cylinder 102 and connectors 104A, 104B and 104C (e.g., screws and connectors). The assembled opposing mounted plates 44A and 44B are connected to the motor housing 37 (e.g., via welding).

Figure 5B:
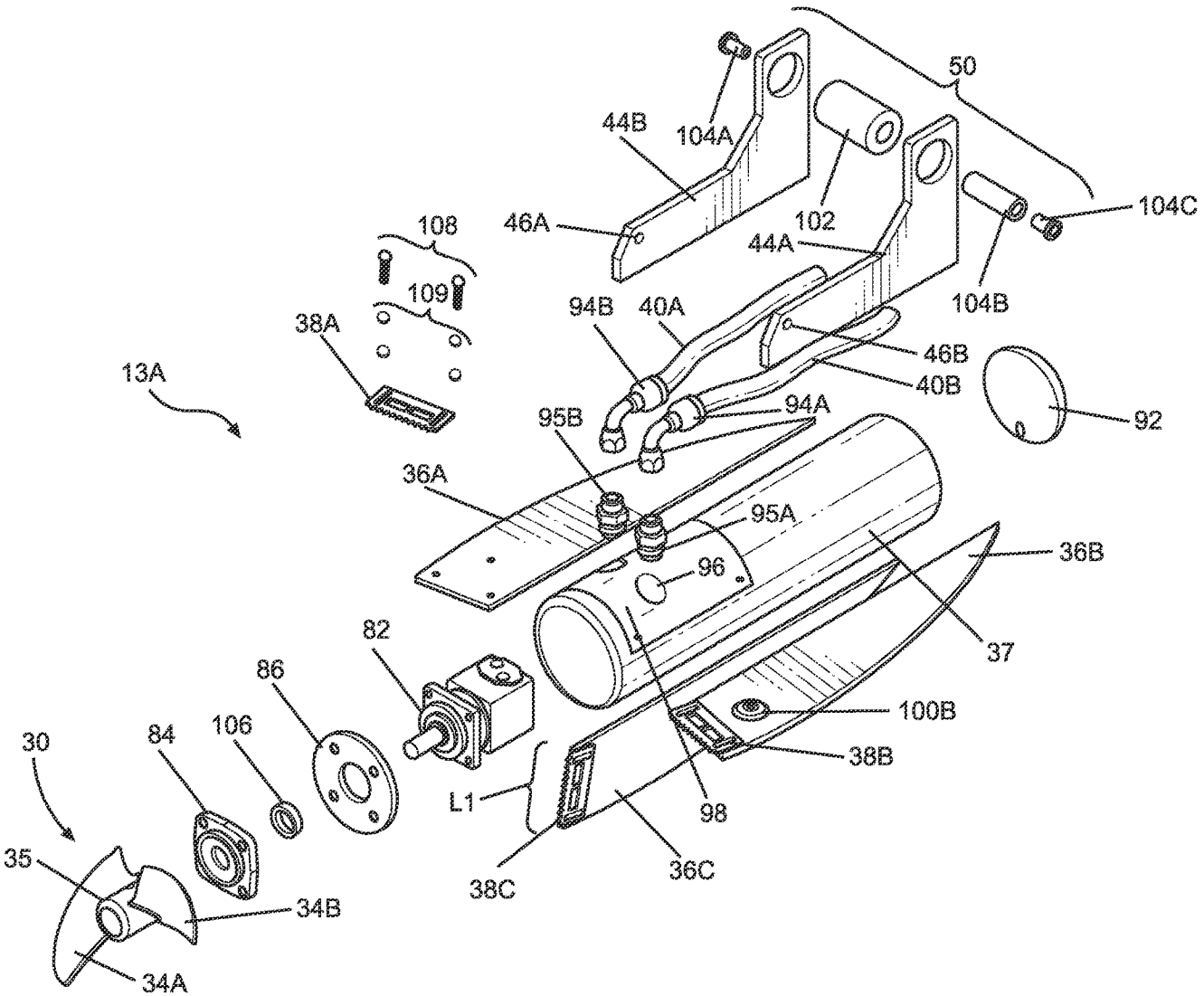
FIG. 5B is another exploded view of the lower outdrive assembly of the outboard drive assembly of FIG. 3 according to embodiments of the invention.

FIG. 5B is another exploded view of the lower outdrive assembly 13A of the outboard drive assembly 12A of FIG. 3 according to embodiments of the invention. In additional to elements depicted in FIG. 5A, FIG. 5B shows a metal clad wiper 106 used in securing the propeller 30 to the hydraulic motor 82, and fasteners 108 and washers 109 utilized to attach the cutter 38A to the fixed fin 36A. It should be understood that cutters 38B and 38C may be similarly fixed to respective fins 36B and 36C. Additionally, adapters 95A and 95B are shown, which are adapted to connect respective hydraulic lines 40A and 40B to the motor housing 37.

Figure 6A:
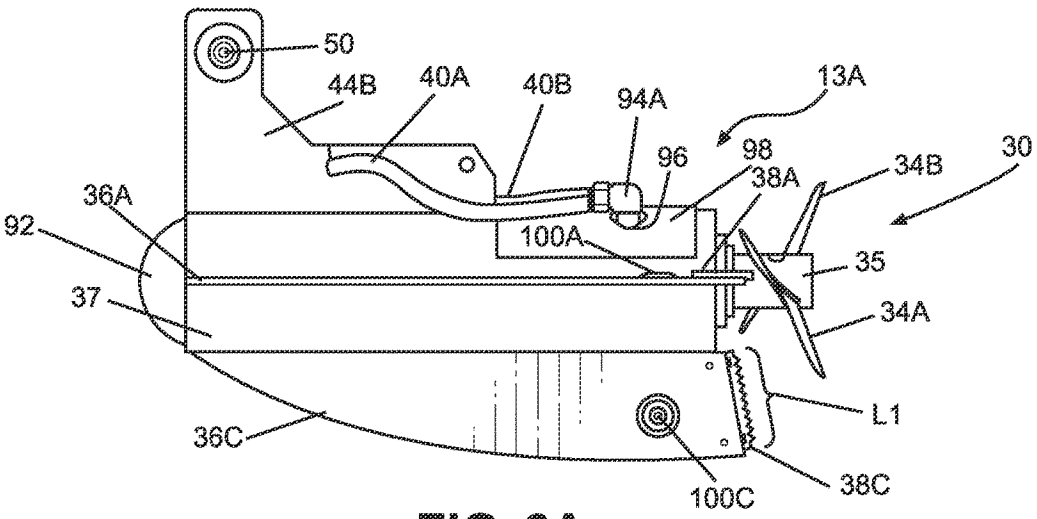
FIG. 6A is a side view of the lower outdrive assembly of FIGS. 5A and 5B according to embodiments of the invention.
Figure 6B:
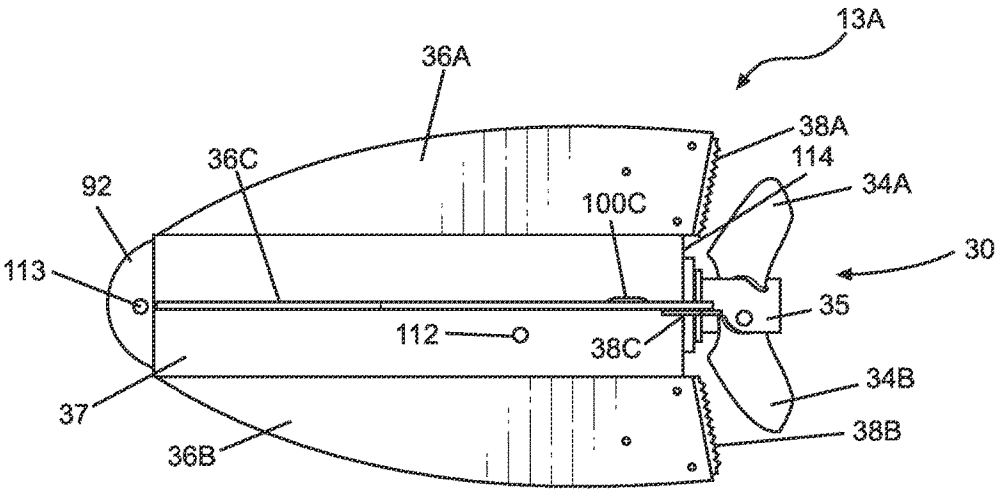
FIG. 6B is a bottom view of the lower outdrive assembly of FIGS. 5A and 5B according to embodiments of the invention.

FIG. 6A is a side view of the lower outdrive assembly 13A of the outboard drive assembly 12A of FIGS. 5A and 5B according to embodiments of the invention. FIG. 6B is a bottom view of the outboard drive of FIG. 3 according to embodiments of the invention. In implementations, the outboard drive assembly 12A includes a hole 112 formed in the motor housing 37, and a hole 113 formed in the domed cap 92, which enable water to flow out of the housing 37 and domed cap 92 for drainage of the outboard drive assembly 12A (e.g., when the outboard drive assembly 12A is in a raised position on the work boat 10). In implementations, the cutting blades of the cutters 38A-38C extend beyond a plane of an end wall 114 of the motor housing 37, and are positioned adjacent the propeller blades 34A, 34B.

Figure 7A:
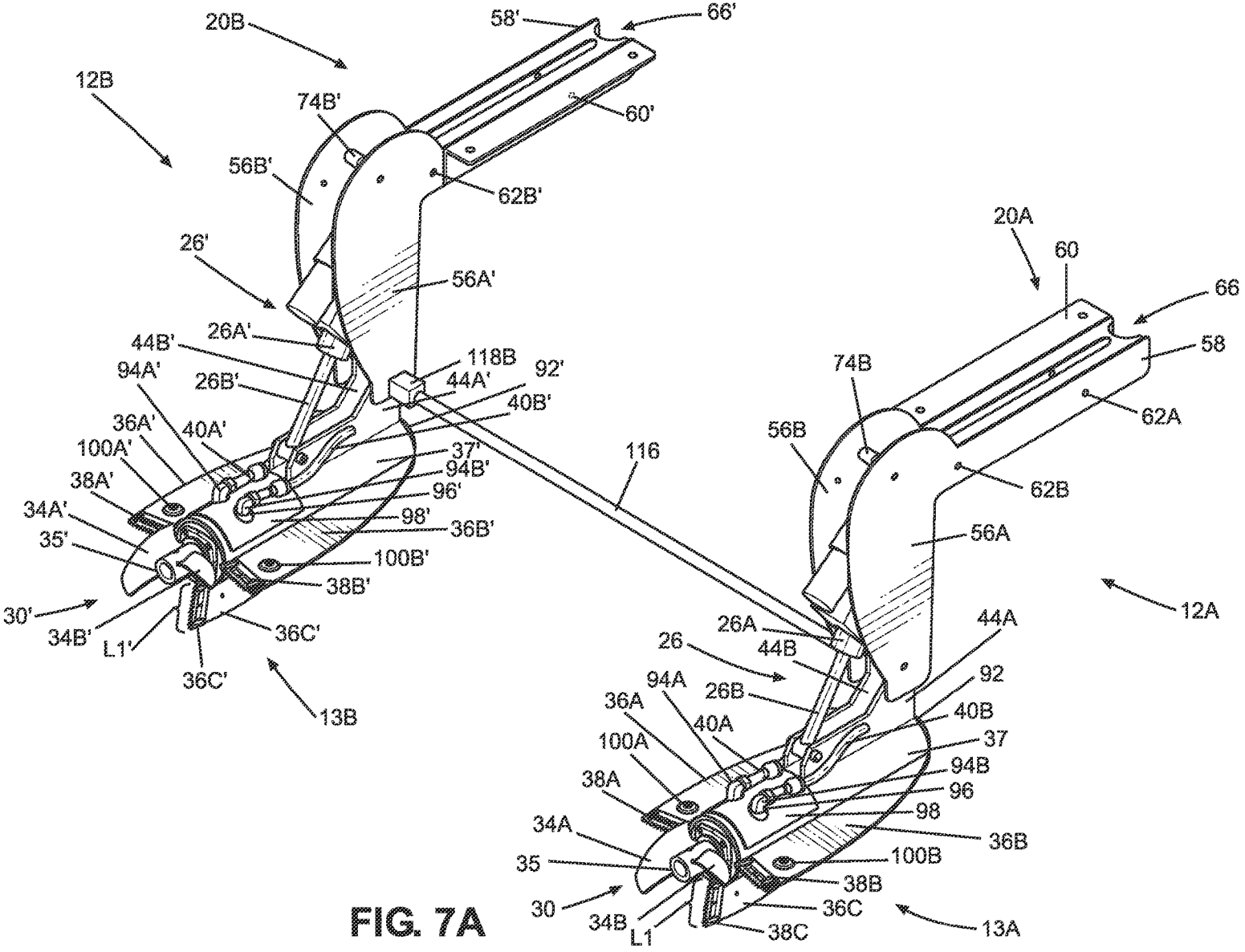
FIG. 7A is a perspective side view of port side and starboard side outboard drive assemblies with a stabilizing bar extended there between in accordance with embodiments of the invention.
Figure 7B:
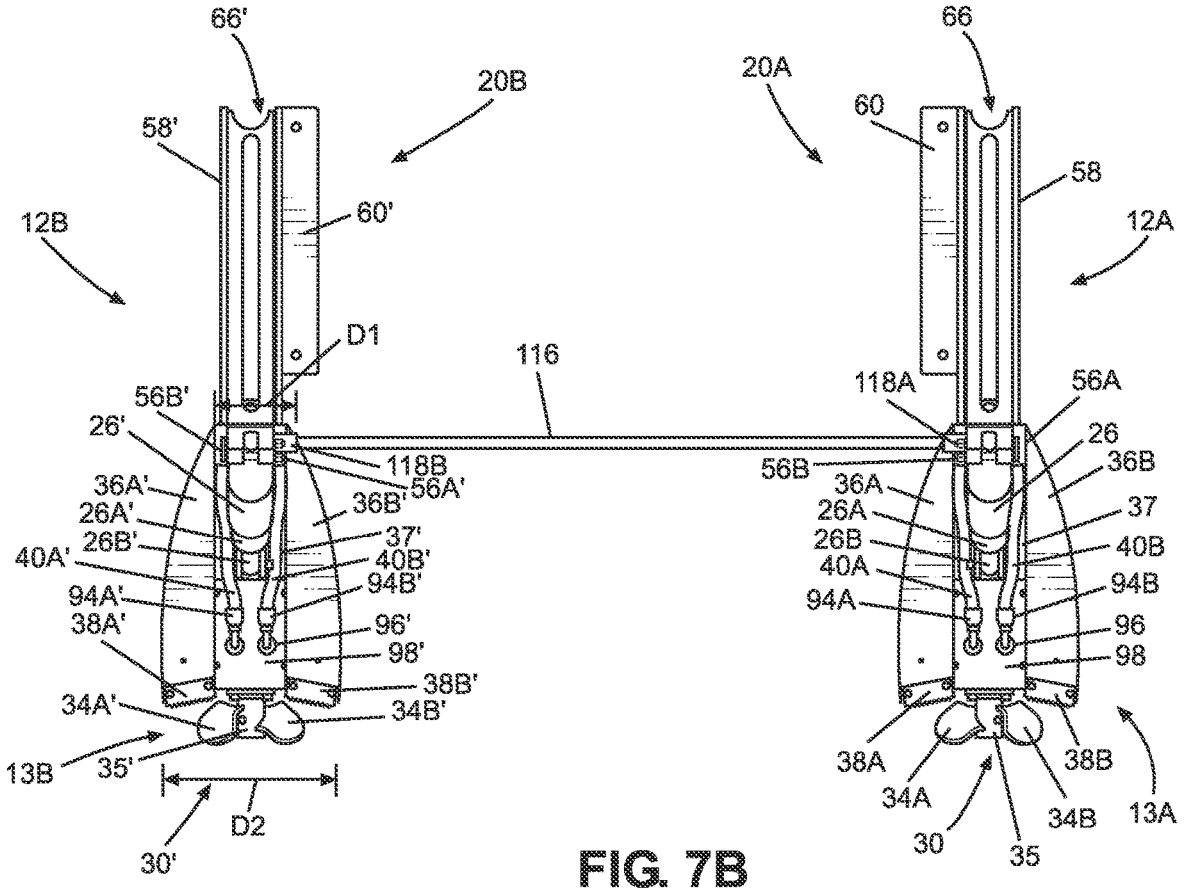
FIG. 7B is a top view of the port side and starboard side outboard drive assemblies of FIG. 7A in accordance with embodiments of the invention.
Figure 7C:
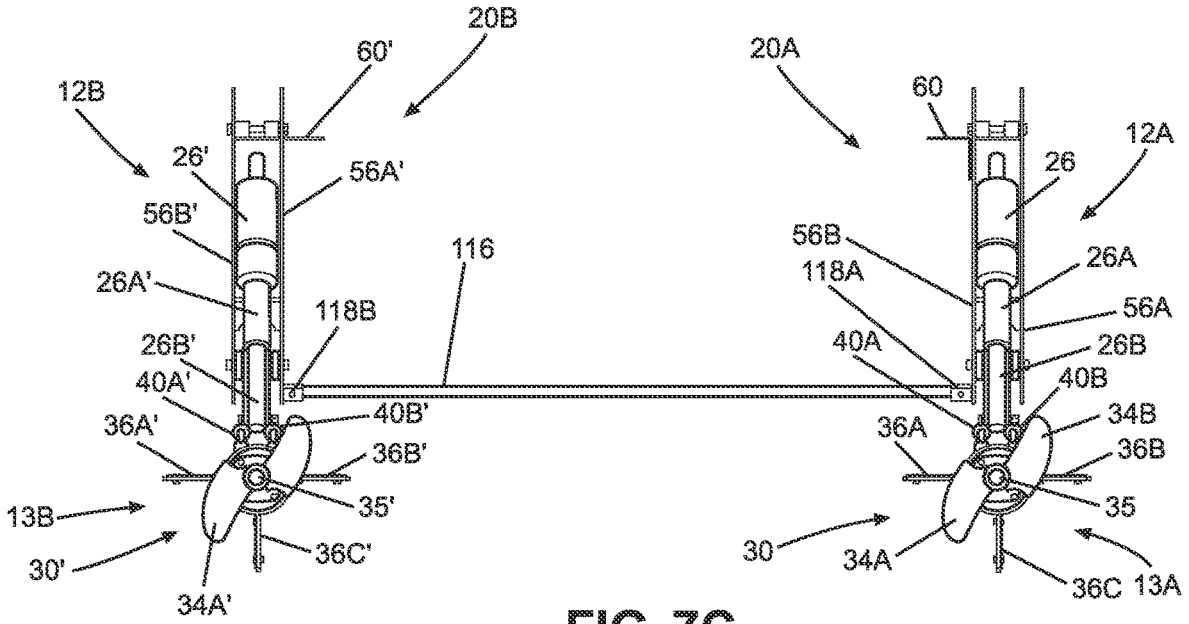
FIG. 7C is a front view of the port side and starboard side outboard drive assemblies of FIG. 7A in accordance with embodiments of the invention.

FIGS. 7A-7C depict a perspective side view, top view and front view of port side and starboard side outboard drive assemblies 12A and 12B in accordance with embodiments of the invention. It should be understood that mounting assembly 20B includes parts corresponding to those of mounting assembly 20A discussed above, and are numbered accordingly with the addition of a prime mark "" to distinguish between the port side mounting assembly 20B and the starboard side mounting assembly 20A.

With initial reference to FIG. 7A, in embodiments, a stabilizing bar 116 extends between the mounting assembly 20A and the mounting assembly 20B to provide stabilization to the respective mounting assemblies 20A, 20B during use. In implementations, the stabilizing bar 116 reduces vibrations and lateral movement of the outboard drive assemblies 12A and 12B during use. In embodiments, the stabilizing bar 116 connects to side plate 56B of mounting assembly 20A and side plate 56A' of mounting assembly 20B by respective brackets 118A, 118B (as depicted in FIGS. 7A, 7B and 7C). As best seen in FIGS. 7A and 7B, embodiments of the invention include outboard drives 12A and 12B having a tapered shape, wherein the overall diameter of each of the outboard drives 12A and 12B increases from a first diameter at the dome caps 92, 92', to a larger diameter at the cutters 38A-38C, 38A'-38C'. See for example, the first diameter D1 at dome cap 92' of the outboard drive assembly 12B, which has a smaller diameter than the second diameter D2 of the outermost ends of fixed fins 36A-36C.

Figure 8:
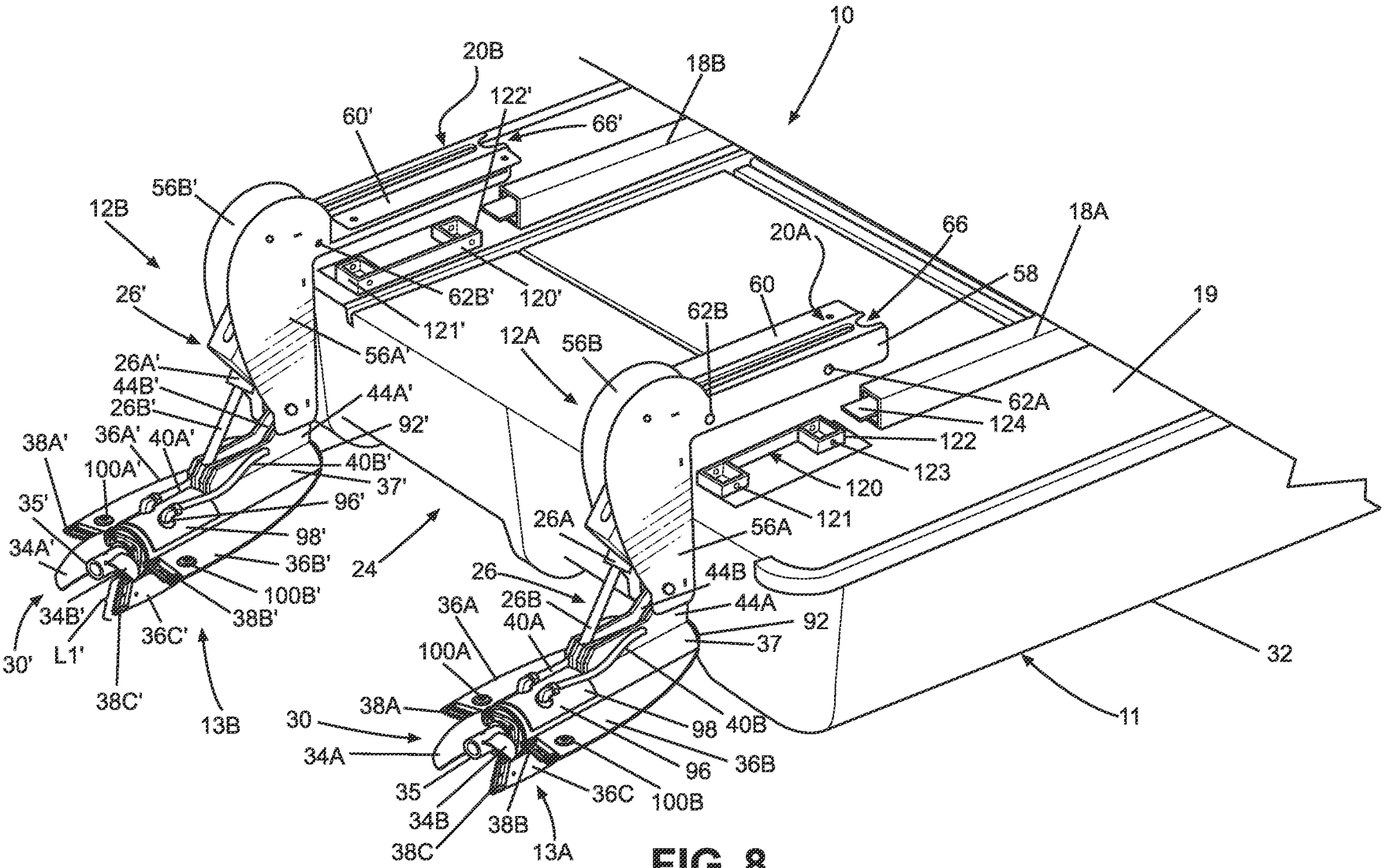
FIG. 8 is a partial exploded perspective view showing a method for mounting outboard drive assemblies to a work boat in accordance with embodiments of the invention.

FIG. 8 is an exploded perspective view showing a method for mounting outboard drive assemblies 12A and 12B to a work boat 10 in accordance with embodiments of the invention. In the example of FIG. 8, a bracket 120 including upstanding mounting blocks 121 and 122 is mounted to the deck 19 of the work boat 10 (e.g., via welding, bolts, screws, or the like), and is adapted to secure the mounting assembly 20A to the work boat 10 via fasteners, such as bolts, screws or the like (not shown). In implementations, the opposing side plates 56A, 56B of the mounting assembly 20A form a channel there between into which the upstanding mounting blocks 121, 122 are received. Bolts (not shown) may extend through apertures 62A and 62B in the mounting assembly 20A and into apertures (e.g., 123) of the upstanding mounting blocks 121, 122 to secure the mounting assembly 20 to the bracket 120. In implementations, the mounting assembly 20A also fits over and/or attaches to an end portion 124 of the mounting rail 18A (e.g., via fasteners or the like). Mounting assembly 20B may be similarly mounted to a bracket 120' including upstanding mounting blocks 121', 122' and/or rail 18B.

Figure 9A:
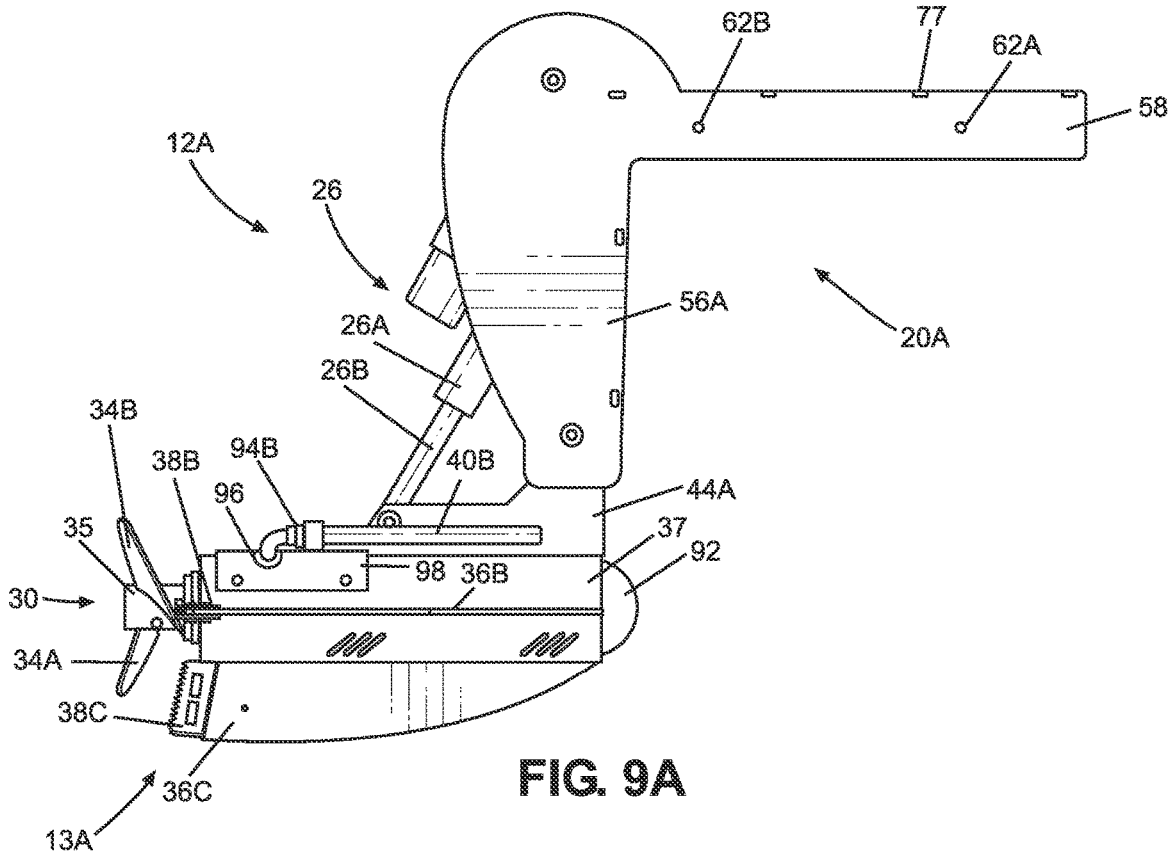
FIG. 9A is a side view of an outboard drive assembly in a lowered position in accordance with embodiments of the invention.
Figure 9B:
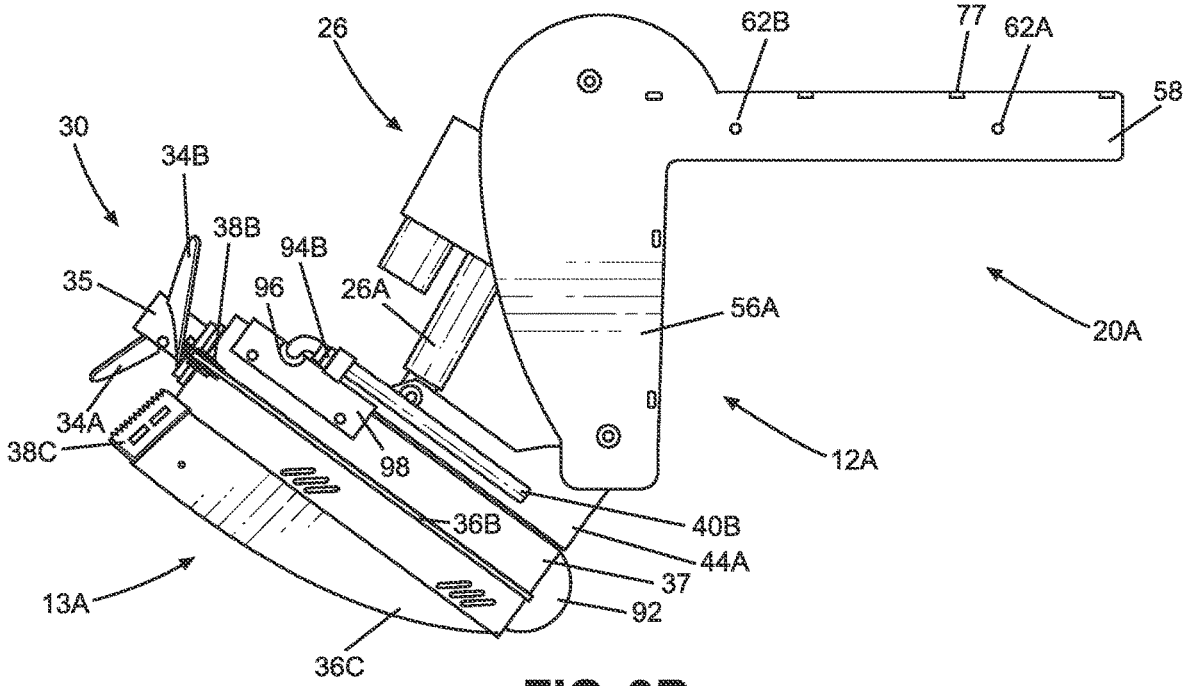
FIG. 9B is a side view of an outboard drive assembly in a raised position in accordance with embodiments of the invention.

FIG. 9A is a side view of an outboard drive assembly 12A in accordance with embodiments of the invention, wherein the outboard drive assembly 12A is in a lowered position. FIG. 9B is a side view of the outboard drive assembly 12A of FIG. 9A, wherein the outboard drive assembly 12A is in a raised position. When mounted to a work boat (e.g., work boat 10) in the lowered position, the outboard drive assembly 12A is under water and is ready to drive movement of the work boat 10, while in the raised position, at least a portion of the outboard drive assembly 12A is above water, enabling the work boat 10 to be safely transported out of water without damaging the outboard drive assembly 12A. It should be understood that outboard drive assembly 12B may likewise be moved between a lowered and a raised position.

Figure 10A:
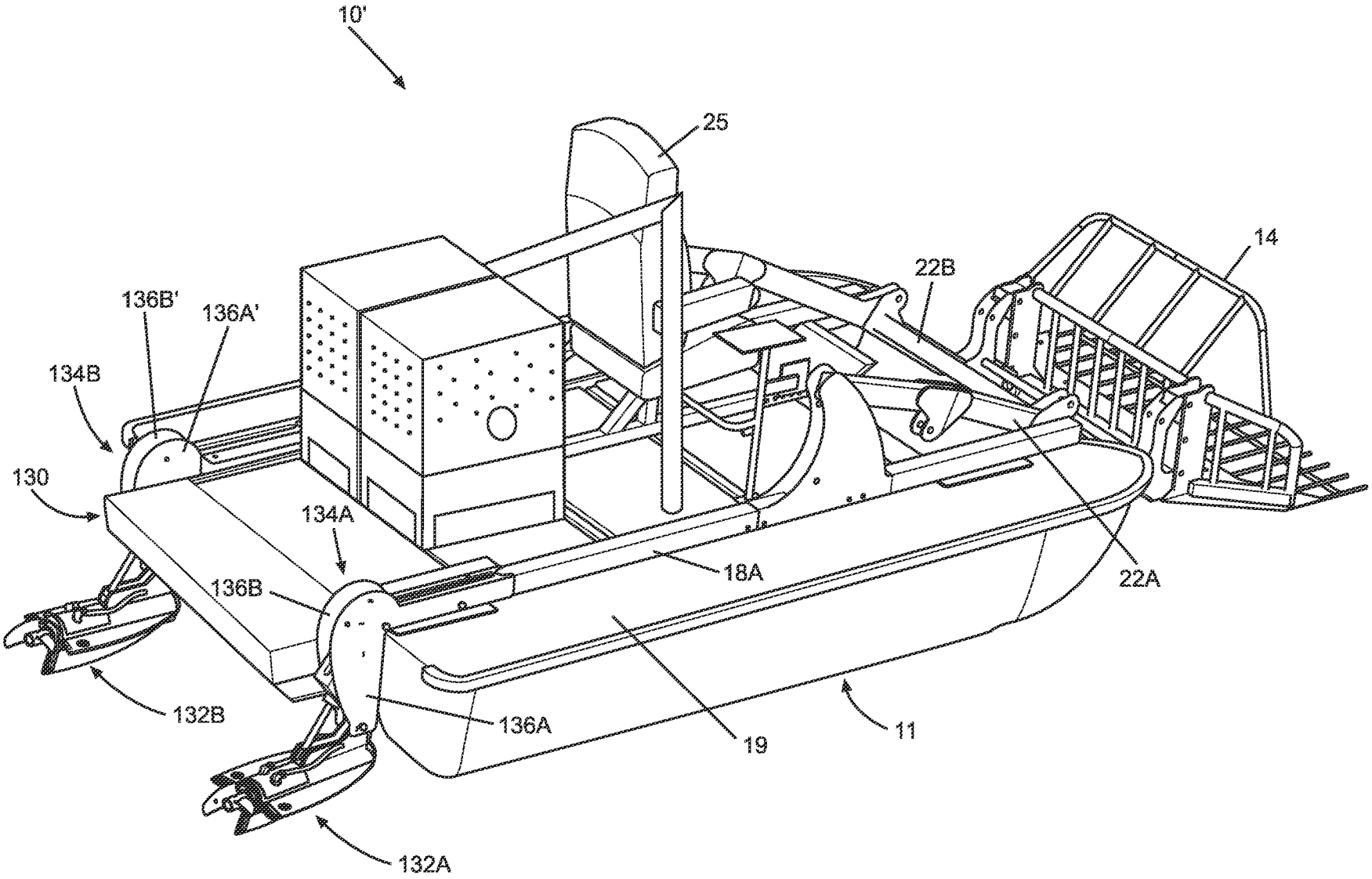
FIG. 10A depicts a work boat including a buoyancy compensator mounted to a deck thereof in accordance with embodiments of the invention.

FIG. 10A depicts a work boat 10' including a buoyancy compensator 130 mounted to a deck 19 thereof in accordance with embodiments of the invention. The work boat 10' may include elements of the work boat 10 of FIG. 1, including a hull 11, a work tool 14, mounting rails (e.g., 18A), an upper deck surface 19, respective pivoting arms 22A, 22B, and a seat 25. The buoyancy compensator 130 comprises outer walls defining a water-tight storage tank configured to selectively hold varying amounts of water. In embodiments, a user can fill or empty the buoyancy compensator 130 with water as desired to provide a ballast at the stern of the work boat 10', in order to stabilize the work boat 10' when utilizing the work tool 14. The work boat 10' also includes lower outdrive assemblies 132A and 132B mounted to the work boat 10' by respective mounting assemblies 134A, 134B. The lower outdrive assemblies 132A and 132B and mounting assemblies 134A, 134B may include elements of the outboard drive assemblies 12A, 12B of FIG. 1. In implementations, the mounting assembly 134A includes opposing side plates 136A, 136B, and the mounting assembly 134B includes opposing side plates 136A', 136B', wherein the buoyancy compensator 130 is mounted between respective side plates 136B and 136A', and provides stabilization between the mounting assemblies 134A, 134B. In implementations, the buoyancy compensator 130 prevents and/or dampens lateral movement of the outboard drives 132A and 132B when in use.

Figure 10B:
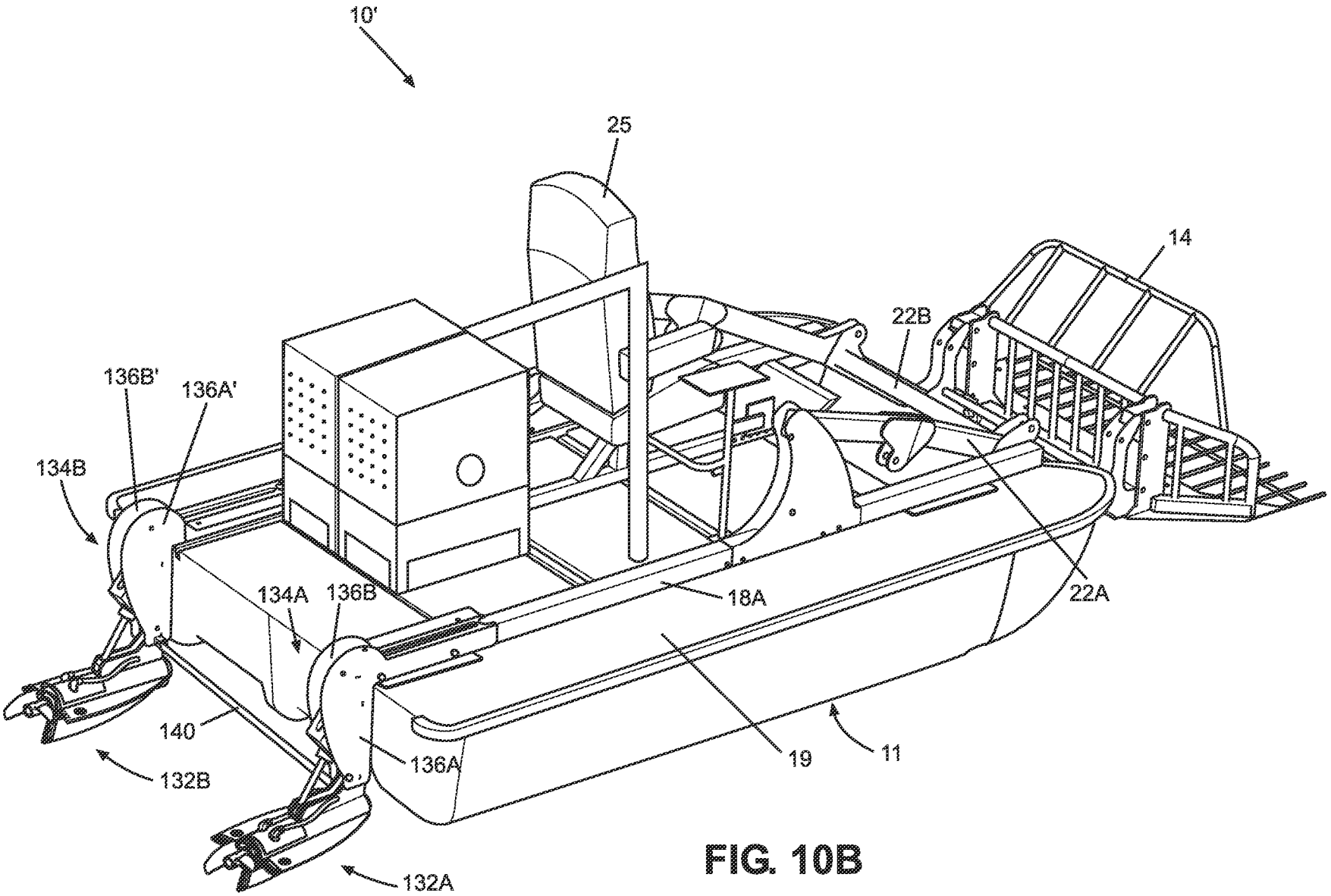
FIG. 10B depicts the work boat of FIG. 10A including a stabilizing bar instead of a buoyancy compensator in accordance with embodiments of the invention.

FIG. 10B depicts the work boat 10' of FIG. 10A including a stabilizer bar 140 instead of a buoyancy compensator 130. In the example of FIG. 10B, the stabilizing bar 140 provides stability between the mounting assemblies 134A, 134B. In implementations, the stabilizing bar 140 prevents and/or dampens lateral movement of the outboard drives 132A and 132B when in use.

Figure 10C:
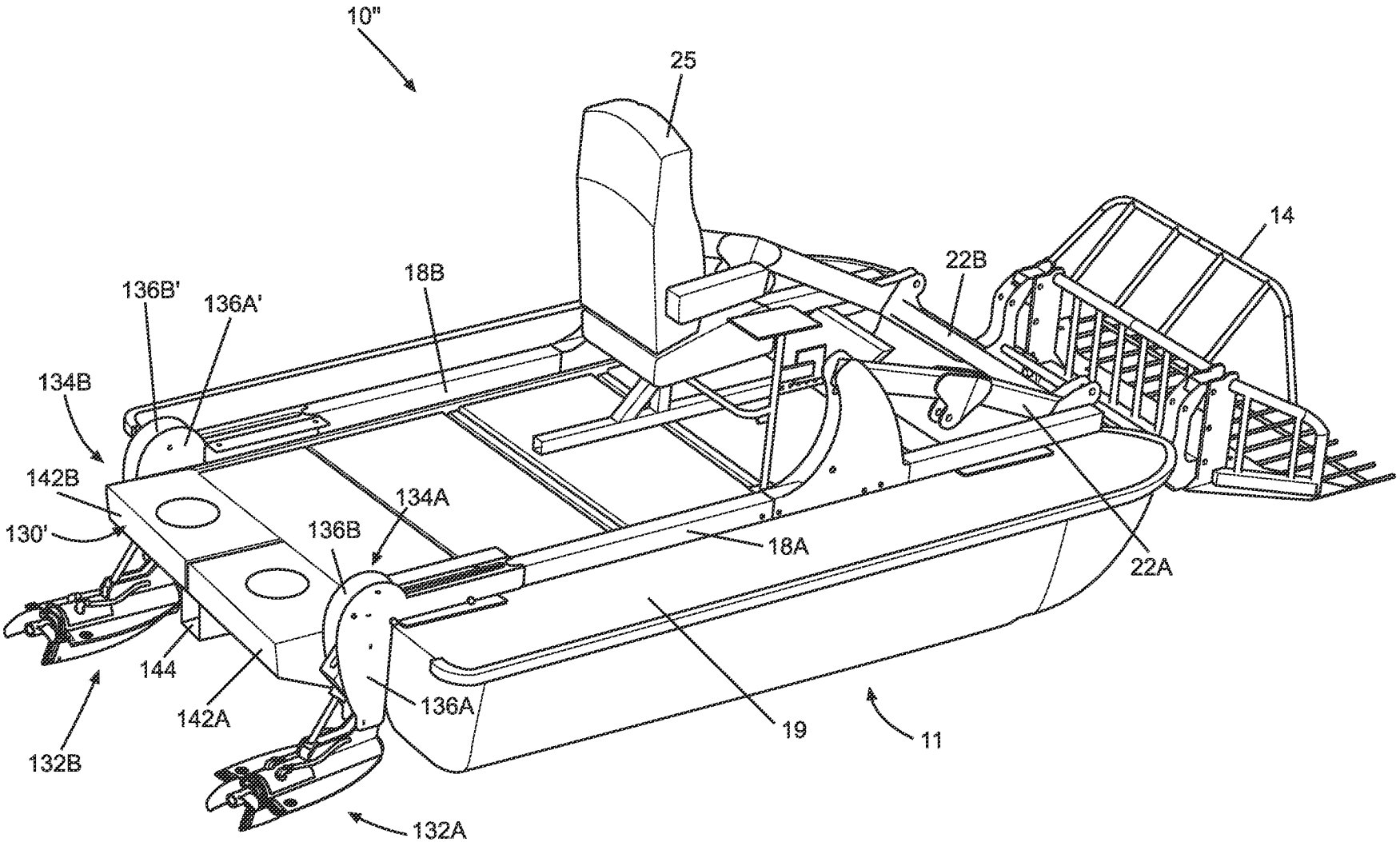
FIG. 10C depicts the work boat including an alternative buoyancy compensator in accordance with embodiments of the invention.

FIG. 10C depicts a work boat 10" including another buoyancy compensator 130' in accordance with embodiments of the invention. The work boat 10" may include elements of the work boat 10 of FIG. 1, including a hull 11, a work tool 14, mounting rails 18A and 18B, an upper deck surface 19, respective pivoting arms 22A, 22B, and a seat 25. The buoyancy compensator 130' of FIG. 10C includes a first side structure defining a first fluid tank 142A, and a second side structure defining a second fluid tank 142B and an inlet/outlet 144 configured to enable a user to selectively empty or fill the first and/or second fluid tanks 142A, 142B (e.g., via a pump system) with water (e.g., river or pond water) to provide a counterbalance to the work tool 14 and any debris being lifted thereby. It should be understood that buoyancy compensators 130 and 130' of the present invention provide a weighted counterbalance to a weight of the work tool 14 and any debris therein, wherein the more water stored within the buoyancy compensators 130, 130', the more weight is provided at the stern of the work boat 10" to counterbalance the work tool 14.

Figure 11B:
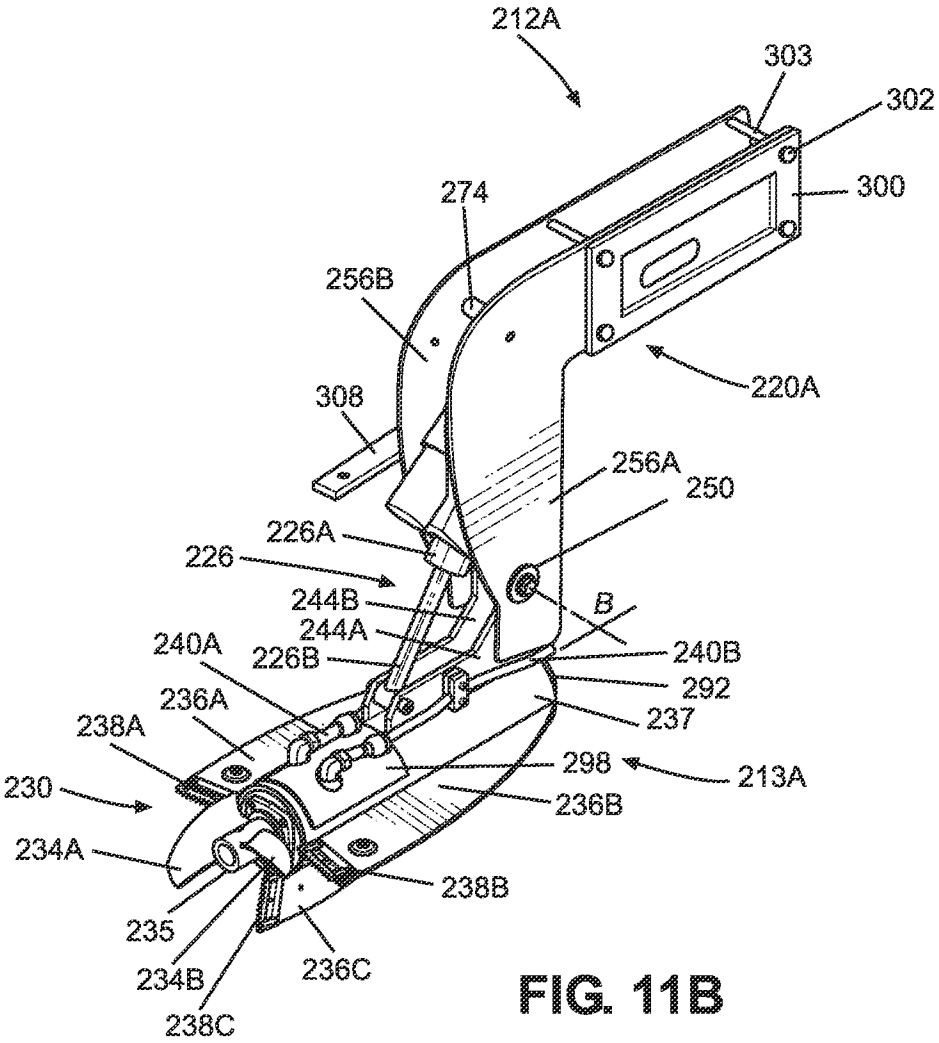
FIG. 11B is a perspective side view of an alternative starboard side outboard drive assembly in accordance with embodiments of the invention.
Figure 11A:
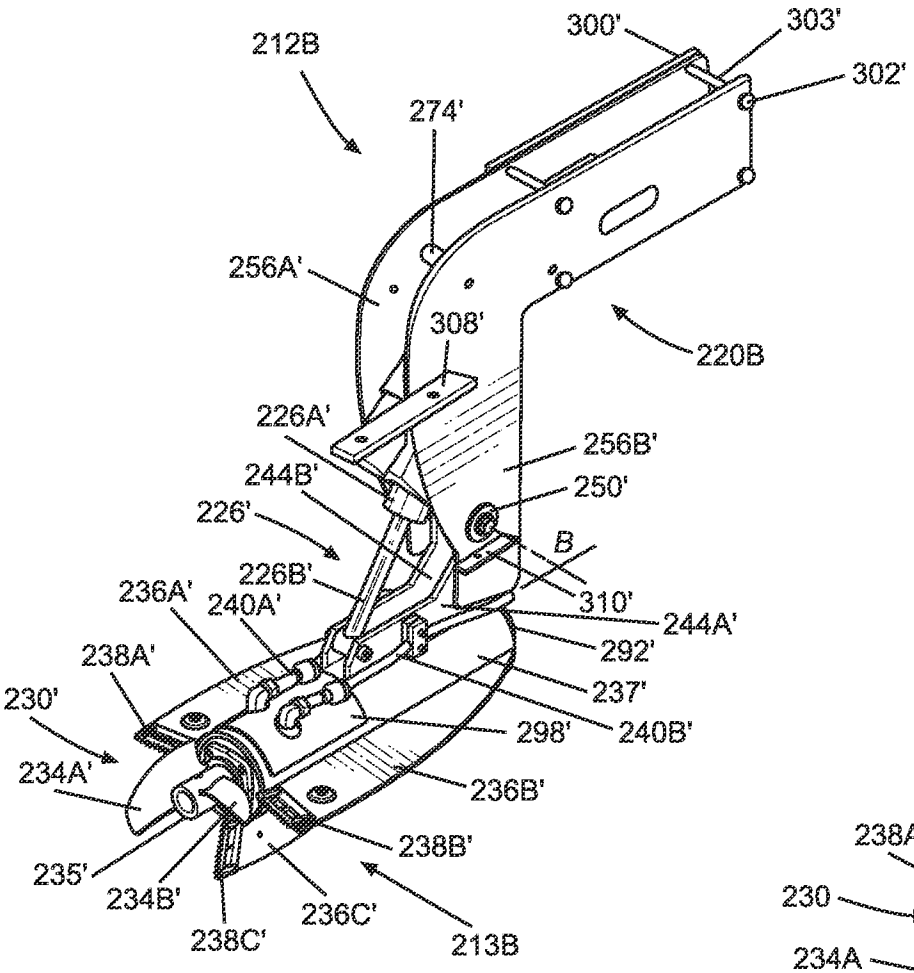
FIG. 11A is a perspective side view of an alternative port side outboard drive assembly in accordance with embodiments of the invention.

FIG. 11A is a perspective side view of an alternative port side outboard drive assembly 212B in accordance with embodiments of the invention. Similarly, FIG. 11B is a perspective side view of an alternative starboard side outboard drive assembly 212A in accordance with embodiments of the invention. Parts of the port side outboard drive assembly 212A of FIG. 11B find correspondence in parts of starboard side outboard drive assembly 212B of FIG. 11A, and are numbered accordingly with the addition of the prime symbol "'" to distinguish between the port side and starboard side outboard drive assemblies 212B and 212A. Accordingly, only the parts of the starboard side outboard drive assembly 212A of FIG. 11B will be discussed herein.

The outdrive assembly 212A includes a lower outdrive assembly 213A and an upper outdrive assembly (mounting assembly) 220A. The upper outdrive assembly 220A is rotatably connected to the lower outdrive 213A by a drive arm assembly 226. In implementations, the drive arm assembly 226 comprising a cylinder 226A and an arm 226B configured to extend and retract from the cylinder 226A to rotate the lower outdrive assembly 213A about an axis B, between a lowered (in-use) position (shown in FIG. 15A) and a raised (travel) position (shown in FIG. 15B) wherein a propeller (prop) 230 is raised upward in the direction of the mounting assembly 220A. The exemplary propeller 230 of FIG. 11B includes two propeller blades 234A and 234B extending from a hub 235, however, other types of propellers may be utilized.

In embodiments, the outboard drive 212A includes a plurality of fixed fins 236A-236C (e.g., aluminum fins) extending from a motor housing 237, each of which includes a respective cutter 238A-238C mounted to an end thereof adjacent the propeller 230. The outboard drive 212A also includes hydraulic hoses or lines 240A and 240B connected thereto. Opposing mounting plates 244A and 244B (e.g., ⅜ inch mount "L" plates) are connected via a connector 250 to the upper outdrive assembly 220A, and are secured (e.g., via welding) to the motor housing 237.

In the embodiment of FIG. 11B, the upper outdrive assembly 220A comprises opposing side plates 256A, 256B spaced from one another by at least one spacer 274. A domed cap 292 is shown at an end of the motor housing 237, and a cover plate 298 is provided in the motor housing 237 to enable access to a motor housed therein. The upper outdrive assembly 220A includes a reinforcing plate 300 secured to the side plate 256A by fasteners (e.g., fastener 302). In embodiments, the fasteners 302 each include a spacer (e.g., spacer 303) that maintains a spaced distance between the side plate 256A and side plate 256B, and provides structural support. In implementations, additional brackets may be connected to the upper outdrive assemblies 220A, 220B for use in attaching tools or parts to the upper outdrive assemblies 220A, 220B. For example, brackets 308 and 308' are shown extending from respective outdrive assemblies 220A, 220B. An additional bracket 310' is shown extending from side wall 256B' in FIG. 11A.

Figure 12:
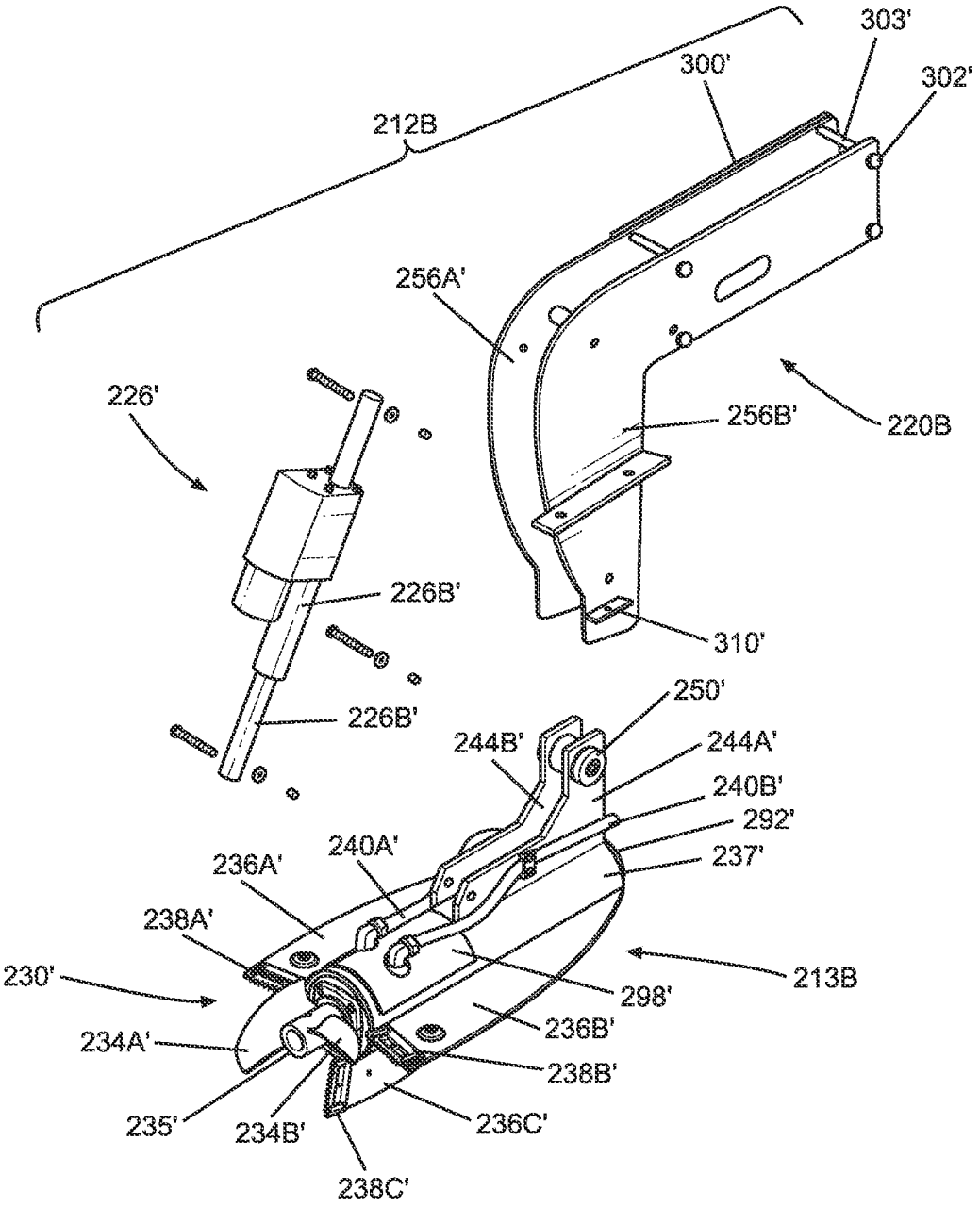
FIG. 12 is a partial exploded view of the outboard drive assembly of FIG. 11B according to embodiments of the invention.

FIG. 12 is a partial exploded view of the outboard drive assembly 212B of FIG. 11A according to embodiments of the invention. It should be understood that the upper outdrive assembly 220B may be pivotally connected to the lower outdrive assembly 213B by the drive arm assembly 226 in a manner similar to the outboard drive assembly 12A of FIG. 3.

Figure 13:
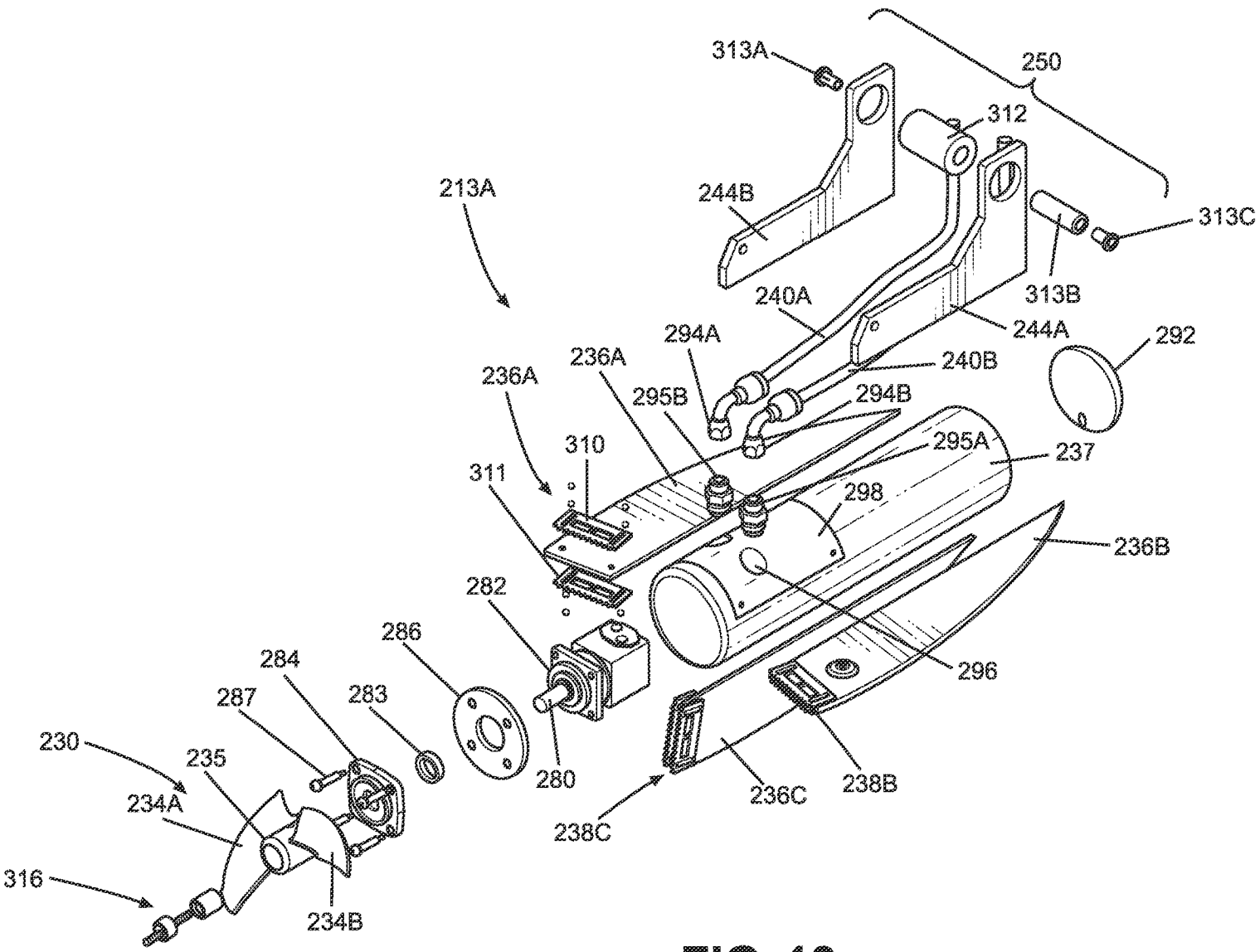
FIG. 13 is an exploded view of a lower outdrive assembly of the outboard drive of FIG. 11B according to embodiments of the invention.

FIG. 13 is an exploded view of a lower outdrive assembly 213A of the outboard drive assembly 212A of FIG. 11B according to embodiments of the invention. In the example of FIG. 13, the outboard drive 212A includes the propeller 230 connected to a shaft 280 of a hydraulic motor 282, with a machined spacer plate 284, metal clad wiper 283, and a housing plate 286 there between (e.g., via fasteners 287). The hydraulic motor 282 is housed within the motor housing 237 sealed at a back end with the domed cap 292. The fixed fins 236A-236C (e.g., aluminum fins) are mounted or affixed to the motor housing 237, and include the respective cutters 238A-238C, each of which including multiple sharp replaceable cutting blades (e.g., 310 and 311) adapted to cut water weeds or other water debris. Crimp fittings 294A and 294B connect the respective hydraulic lines 240A and 240B to the hydraulic motor 282 through holes 296 in a cover plate 298 attached to the motor housing 237. The opposing mounting plates 244A and 244B are connected via the connector 250, which comprises a cylinder 312 and connectors 313A, 313B and 313C (e.g., screws and connectors). Adapters 295A and 295B are shown, which are configured to connect respective hydraulic lines 240A and 240B to the motor housing 237. A fastener 316 is also shown for connecting the propeller 230 to the motor 282.

Figure 14A:
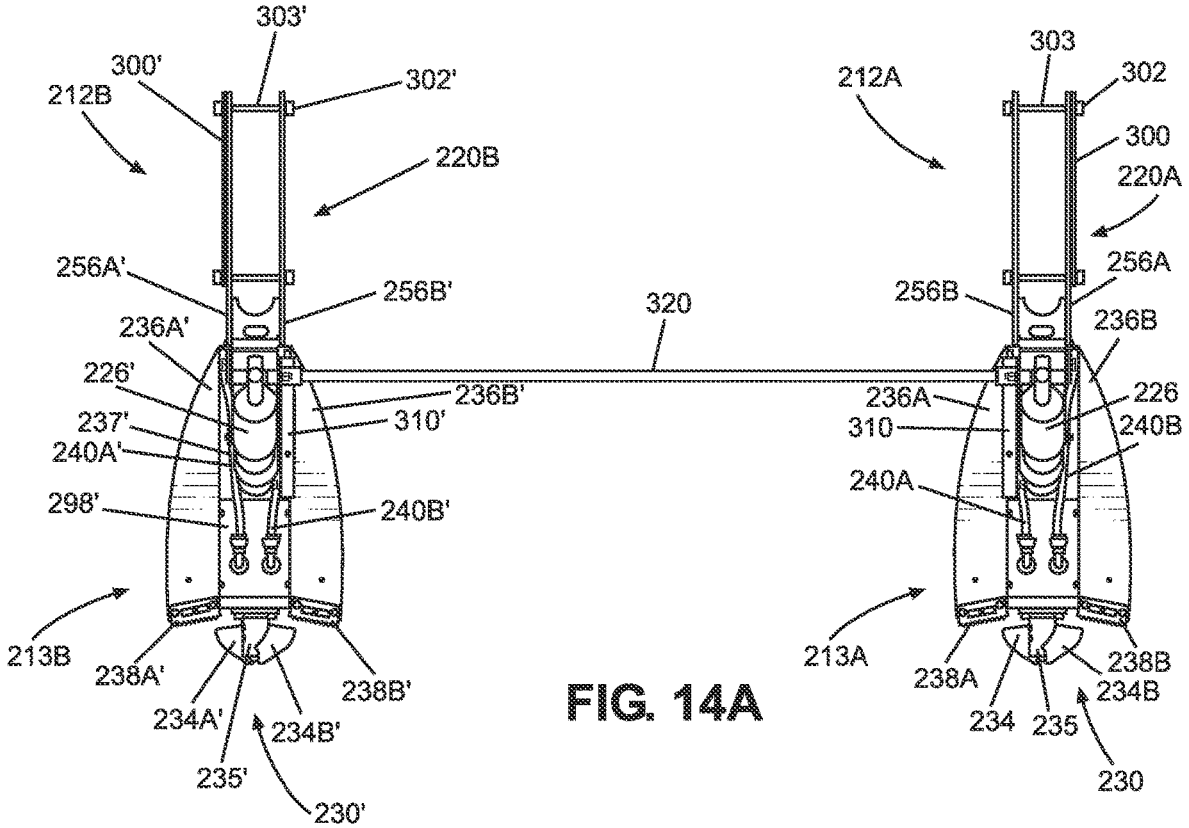
FIG. 14A is a top view of the port side and starboard side outboard drive assemblies of FIGS. 11A and 11B in accordance with embodiments of the invention.
Figure 14B:
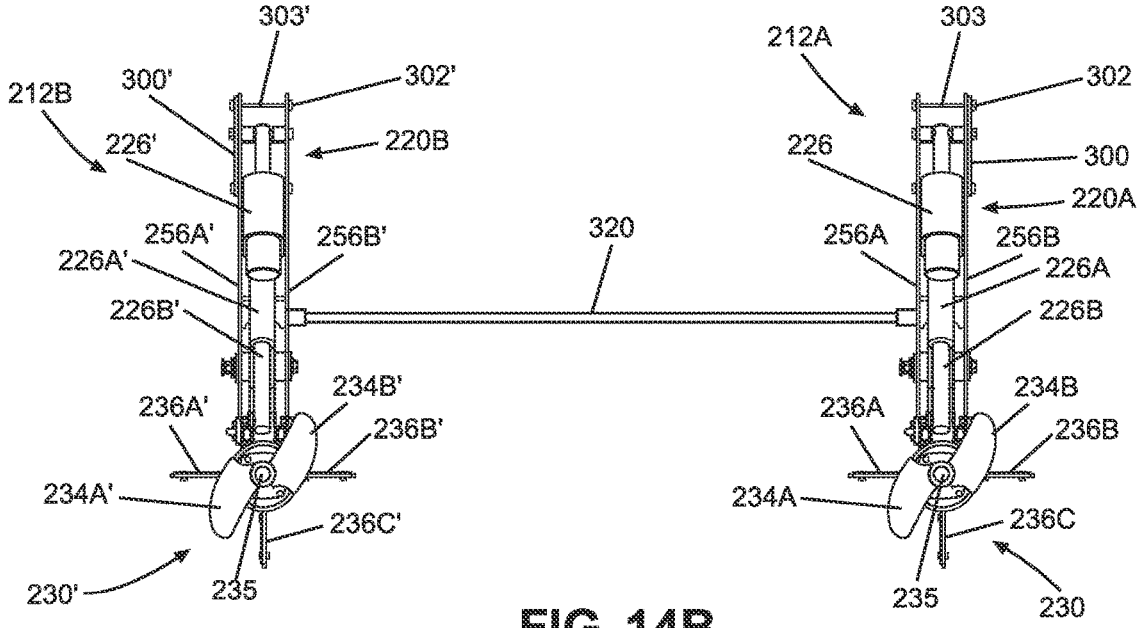
FIG. 14B is a front view of the port side and starboard side outboard drive assemblies of FIGS. 11A and 11B in accordance with embodiments of the invention.

FIG. 14A is a top view of the port side and starboard side outboard drive assemblies 212B and 212A of FIGS. 11A and 11B in accordance with embodiments of the invention. FIG. 14B is a front view of the port side and starboard side outboard drive assemblies 212B and 212A of FIGS. 11A and 11B in accordance with embodiments of the invention. In certain implementations, a stabilizing bar 320 interconnects the port side outboard drive assembly 212B and the starboard side outboard drive assembly 212A.

Figure 15A:
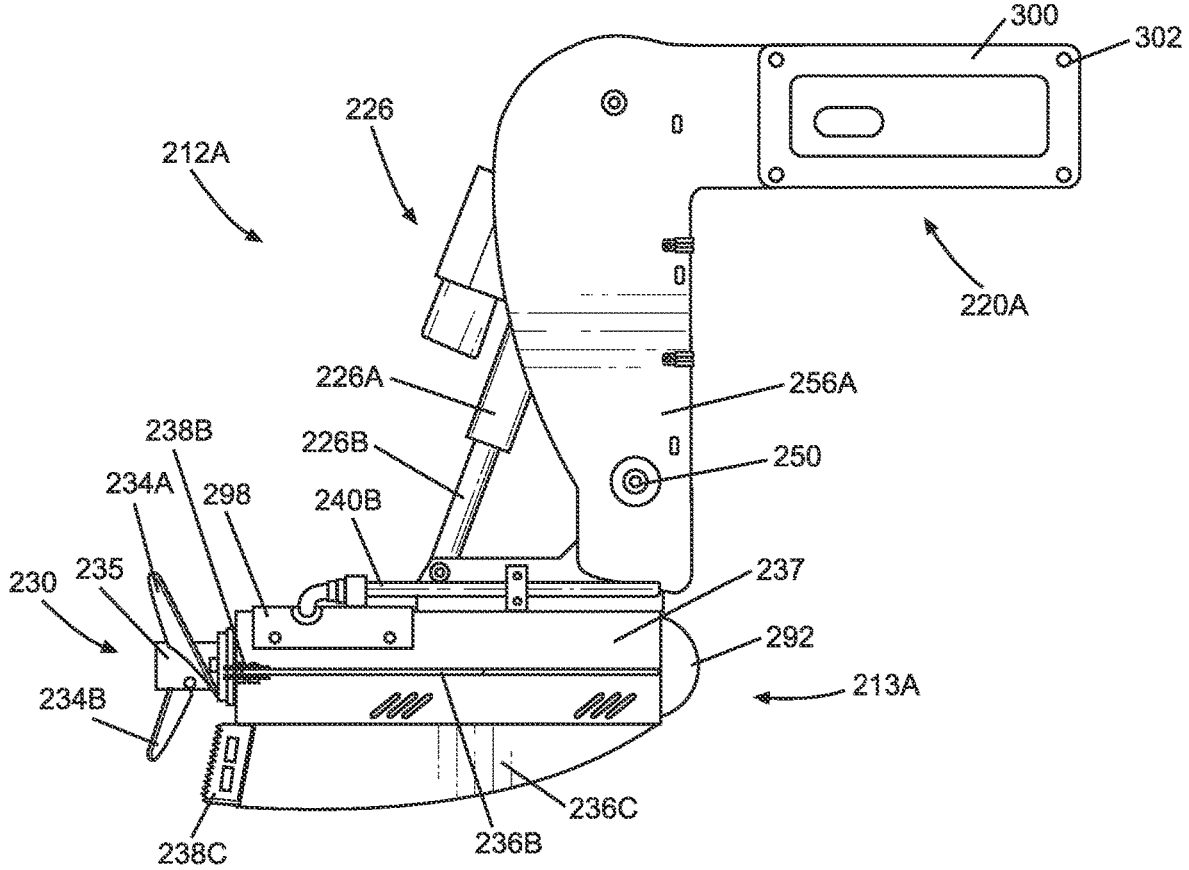
FIG. 15A is a side view of an outboard drive assembly of FIG. 11B in a lowered position in accordance with embodiments of the invention.
Figure 15B:
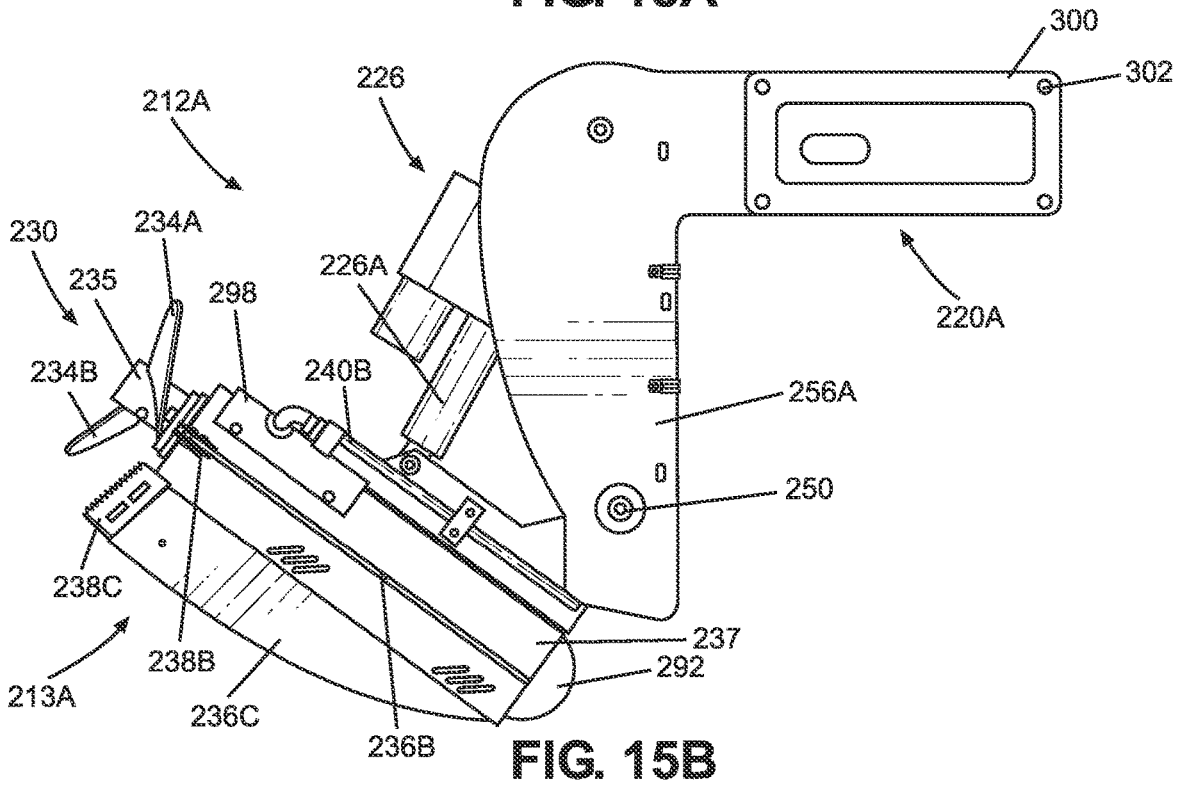
FIG. 15B is a side view of an outboard drive assembly of FIG. 11B in a raised position in accordance with embodiments of the invention.

FIG. 15A is a side view of an outboard drive assembly 212A of FIG. 11B in a lowered position in accordance with embodiments of the invention. FIG. 15B is a side view of an outboard drive assembly 212A of FIG. 11B in a raised position in accordance with embodiments of the invention. When mounted to a work boat (e.g., work boat 10) in the lowered position, the outboard drive assembly 212A is under water and is ready to drive movement of the work boat 10, while in the raised position, at least a portion of the outboard drive assembly 212A is above water, enabling the work boat to be safely transported out of water without damaging the outboard drive assembly 212A. It should be understood that outboard drive assembly 212B may likewise be moved between a lowered and a raised position.

Figure 16:
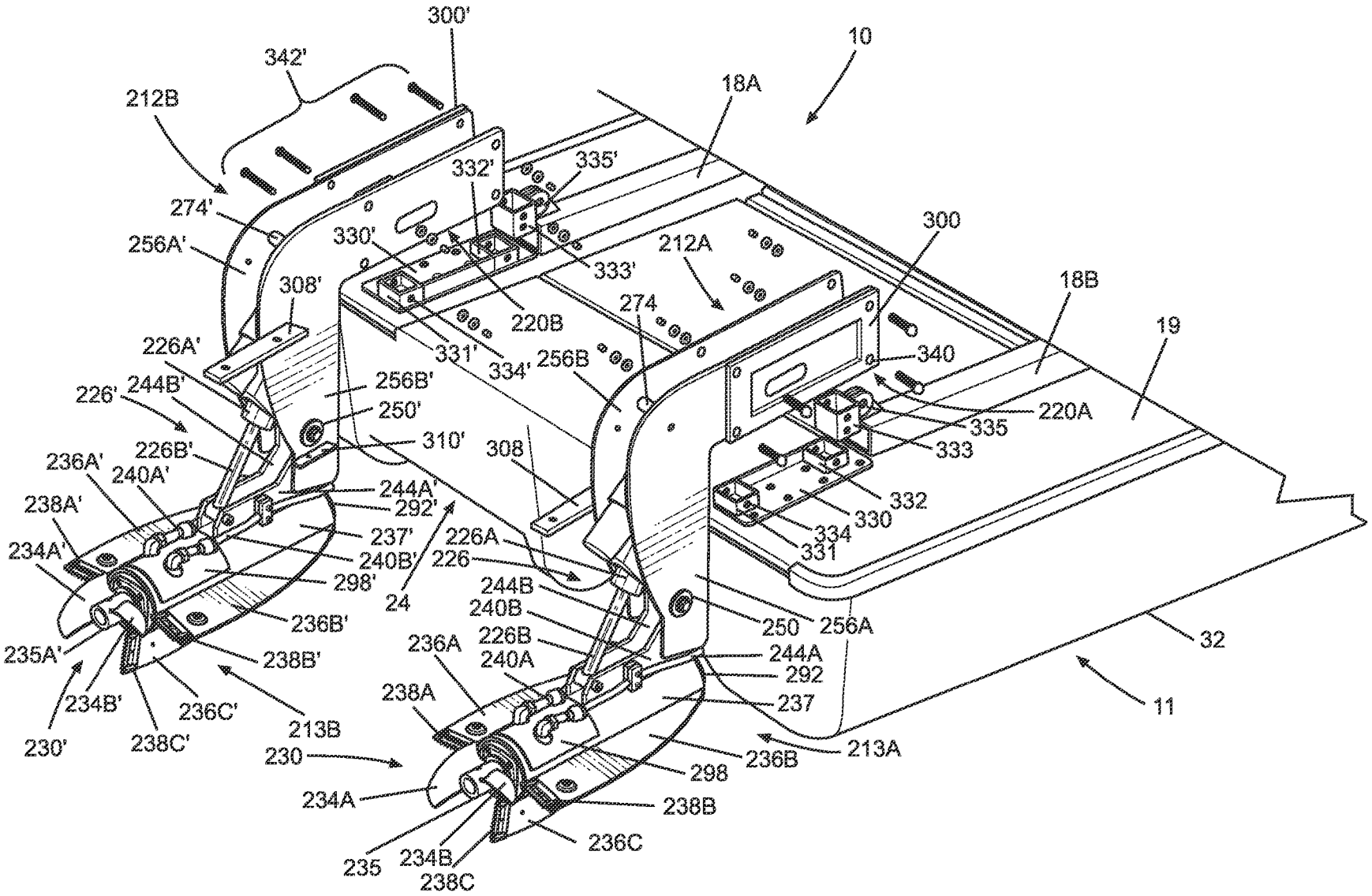
FIG. 16 is an exploded perspective view showing a method for mounting outboard drive assemblies to a work boat in accordance with embodiments of the invention.

FIG. 16 is an exploded perspective view showing a method for mounting outboard drive assemblies 212A and 212B to a work boat 10 in accordance with embodiments of the invention. In the example of FIG. 16, a bracket 330 including upstanding mounting blocks 331 and 332 is mounted to the deck 19 of the work boat 10 (e.g., via welding, bolts, screws, or the like), and is adapted to secure the upper outdrive assembly 220A to the work boat 10. In embodiments, a second bracket 333 is secured to the rail 18B of the work boat (e.g., via welding, bolts, or the like). In implementations, the opposing side plates 256A, 256B of the upper outdrive assembly 220A form a channel there between into which the upstanding mounting blocks 331, 332, and the second bracket 333 are received. A set of fasteners may be used to secure the upper outdrive assembly to the upstanding mounting blocks 331, 332 and the second bracket 333 via apertures in the upper outdrive assembly 220A (e.g., aperture 340) and corresponding apertures (e.g., 334) in the second bracket 333 and upstanding mounting blocks, to secure the upper outdrive assembly 220A to the bracket 330. Upper outdrive assembly 220B may similarly be mounted to a bracket 330' including upstanding mounting blocks 331', 332', and a second bracket 333' (e.g., using the set of fasteners indicated at 342').

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An outboard drive assembly for a work boat comprising:

a lower outdrive assembly including:

a motor housing extending between a first end and a second end, the motor housing including a motor housed therein;

a propeller mounted to the first end of the motor housing, the propeller including propeller blades adapted to rotate about a longitudinal axis of the motor housing;

a first fin extending outward from a first sidewall portion of the motor housing, the first fin including a first cutter extending from an end portion of the first fin adjacent the propeller blades, wherein a cutting blade of the first cutter has a sharp length that extends from a first end adjacent the motor housing to a second end spaced outward from the motor housing;

a second fin extending outward from a second sidewall portion of the motor housing, the second fin including a second cutter extending from an end portion of the second fin adjacent the propeller blades, wherein a cutting blade of the second cutter has a sharp length that extends from a first end adjacent the motor housing to a second end spaced outward from the motor housing;

a third fin extending outward from a first sidewall portion of the motor housing, the third fin including a third cutter extending from an end portion of the third fin adjacent the propeller blades, wherein a cutting blade of the third cutter has a sharp length that extends from a first end adjacent the motor housing to a second end spaced outward from the motor housing; and an upper outdrive assembly configured to connect an upper drive assembly to the work boat, wherein the upper outdrive assembly comprises opposing side plates defining a channel into which a bracket of the work boat may be inserted, wherein fasteners are inserted through corresponding apertures in the opposing side plates and bracket to secure the upper outdrive assembly to the work boat.

2. The outboard drive assembly of claim 1, wherein the cutting blades of each of the first cutter, second cutter and third cutter have a length extending essentially perpendicularly to the longitudinal axis of the motor housing.

3. The outboard drive assembly of claim 1, wherein the each of the first cutter, second cutter and third cutter comprises a second cutting blade.

4. The outboard drive assembly of claim 1, further comprising: a drive arm assembly pivotally mounted to the lower outdrive assembly at a first end of the drive arm assembly and mounted to the upper outdrive assembly at a second end of the drive arm assembly such that extending and retracting an arm of the drive arm assembly moves the lower outdrive assembly between a lowered position and a raised position.

5. The outboard drive assembly of claim 1, wherein the first fin, second fin and third fin each extend from a first end of the motor housing, along a length of the motor housing, to a second end of the motor housing adjacent the propeller.

6. The outboard drive assembly of claim 5, wherein each of the first fin, second fin and third fin taper from a first width at the second end to a smaller width at the first end.

7. The outboard drive assembly of claim 1, wherein the cutting blades of each respective first, second and third fin extend past an end of the motor housing adjacent the propeller blades.

8. A work boat comprising:

a hull;

a deck attached to the hull;

first and second outboard drive assemblies mounted at opposing side portions of the deck, wherein each of the first and second outdrive assemblies include a lower outdrive assembly including:

a motor housing extending between a first end and a second end, the motor housing including a motor housed therein;

a propeller mounted to the first end of the motor housing, the propeller including propeller blades adapted to rotate about a longitudinal axis of the motor housing;

a first fin extending outward from a first sidewall portion of the motor housing, the first fin including a first cutter extending from an end portion of the first fin adjacent the propeller blades, wherein a cutting blade of the first cutter has a sharp length that extends from a first end adjacent the motor housing to a second end spaced outward from the motor housing;

a second fin extending outward from a second sidewall portion of the motor housing, the second fin including a second cutter extending from an end portion of the second fin adjacent the propeller blades, wherein a cutting blade of the second cutter has a sharp length that extends from a first end adjacent the motor housing to a second end spaced outward from the motor housing; and a third fin extending outward from a first sidewall portion of the motor housing, the third fin including a third cutter extending from an end portion of the third fin adjacent the propeller blades, wherein a cutting blade of the third cutter has a sharp length that extends from a first end adjacent the motor housing to a second end spaced outward from the motor housing, wherein the first and second outboard drive assemblies are mounted to the opposing side portions of the deck by respective first and second upper outdrive assemblies, and the first and second upper outdrive assemblies each include: opposing side plates defining a channel into which a bracket of the work boat may be inserted, wherein fasteners are inserted through corresponding apertures in the opposing side plates and bracket to secure the opposing side plates to the work boat.

9. The work boat of claim 7, wherein for each of the lower outdrive assemblies, the cutting blades of each of the first cutter, second cutter and third cutter have a length extending essentially perpendicularly to the longitudinal axis of the motor housing.

10. The work boat of claim 8, wherein for each of the lower outdrive assemblies, each of the first cutter, second cutter and third cutter comprises a second cutting blade.

11. The work boat of claim 8, wherein:

the first outboard drive assembly further comprises:

a first drive arm assembly pivotally mounted to the lower outdrive assembly of the first outboard drive assembly at a first end of the first drive arm assembly and mounted to the first upper outdrive assembly at a second end of the first drive arm assembly such that extending and retracting an arm of the first drive arm assembly moves the lower outdrive assembly of the first outboard drive assembly between a lowered position and a raised position; and the second outboard drive assembly further comprises:

a second drive arm assembly pivotally mounted to the lower outdrive assembly of the second outboard drive assembly at a first end of the second drive arm assembly and mounted to the first upper outdrive assembly at a second end of the second drive arm assembly such that extending and retracting an arm of the second drive arm assembly moves the lower outdrive assembly of the second outboard drive assembly between a lowered position and a raised position.

12. The work boat of claim 8, further comprising a stabilizing bar extending between the first outboard drive assembly and the second outboard drive assembly to reduce movement of the respective first and second outboard drive assemblies during use.

13. The work boat of claim 8, further comprising a work tool mounted at a front of the work boat and adapted to lift debris from water.

14. A work boat comprising:

a hull;

a deck attached to the hull;

first and second outboard drive assemblies mounted at opposing side portions of the deck, wherein each of the first and second outdrive assemblies include a lower outdrive assembly including:

a motor housing extending between a first end and a second end, the motor housing including a motor housed therein;

a propeller mounted to the first end of the motor housing, the propeller including propeller blades adapted to rotate about a longitudinal axis of the motor housing;

a first fin extending outward from a first sidewall portion of the motor housing, the first fin including a first cutter extending from an end portion of the first fin adjacent the propeller blades, wherein a cutting blade of the first cutter has a sharp length that extends from a first end adjacent the motor housing to a second end spaced outward from the motor housing;

a second fin extending outward from a second sidewall portion of the motor housing, the second fin including a second cutter extending from an end portion of the second fin adjacent the propeller blades, wherein a cutting blade of the second cutter has a sharp length that extends from a first end adjacent the motor housing to a second end spaced outward from the motor housing;

a third fin extending outward from a first sidewall portion of the motor housing, the third fin including a third cutter extending from an end portion of the third fin adjacent the propeller blades, wherein a cutting blade of the third cutter has a sharp length that extends from a first end adjacent the motor housing to a second end spaced outward from the motor housing; and a work tool mounted at a front of the work boat and adapted to lift debris from water;

a buoyancy compensator extending between the first outboard drive assembly and the second outboard drive assembly at a back end of the work boat, wherein the buoyancy compensator is adapted to hold fluid to provide a weighted counterbalance to a weight of the work tool.

15. The work boat of claim 8, wherein the first fin, the second fin and the third fin each extend perpendicularly from a first end of the motor housing, along a length of the motor housing, to a second end of the motor housing adjacent the propeller.

16. The work boat of claim 15, wherein each of the first fin, second fin and third fin taper from a first width at the second end to a smaller width at the first end, such that an overall outer diameter of the lower outdrive assembly at the first end is smaller than the overall outer diameter of the lower outdrive assembly at the second end adjacent the propeller.

* * * * *